US005626115A

United States Patent [19]

Kawaguchi

[11] Patent Number: 5,626,115

[45] Date of Patent: May 6, 1997

[54] COMPRESSION-IGNITION TYPE ENGINE

[75] Inventor: Akio Kawaguchi, Susono, Japan

[73] Assignee: Toyota Jidosha Kabushiki Kaisha, Aichi, Japan

[21] Appl. No.: 610,819

[22] Filed: Mar. 7, 1996

[30] Foreign Application Priority Data

Mar. 10, 1995 [JP] Japan ..... 7-051060

[51] Int. Cl.[6] ..... F02B 3/08; F02M 61/00

[52] U.S. Cl. ..... 123/305; 123/447; 123/506; 239/487; 239/533.12

[58] Field of Search ..... 123/294, 305, 123/447, 457, 458, 459, 506; 239/487, 488, 533.12

[56] References Cited

U.S. PATENT DOCUMENTS

| | | | |
|---|---|---|---|
| 4,653,694 | 3/1987 | Noguchi et al. | 239/533.12 |
| 5,341,783 | 8/1994 | Beck et al. | 123/446 |
| 5,467,757 | 11/1995 | Yanagihara et al. | 123/305 |

FOREIGN PATENT DOCUMENTS

| | | |
|---|---|---|
| 1063460 | 5/1954 | France . |
| 2276879 | 1/1976 | France . |
| 2528913 | 12/1983 | France . |
| 60-256523 | 12/1985 | Japan . |
| 61-149568 | 7/1986 | Japan . |
| 62-87609 | 4/1987 | Japan . |
| 3-160150 | 7/1991 | Japan . |
| 4-19355 | 1/1992 | Japan . |
| 4-308356 | 10/1992 | Japan . |
| 927050 | 5/1963 | United Kingdom . |
| 2113300 | 8/1983 | United Kingdom . |

*Primary Examiner*—Tony M. Argenbright
*Attorney, Agent, or Firm*—Kenyon & Kenyon

[57] ABSTRACT

A compression-ignition type engine in which fuel is injected in a combustion chamber during the compression stroke or intake stroke before 60 degrees before top dead center of the compression stroke and at this time, the spread angle of the injected fuel is made small as the position of the piston is low. In addition, at this time, the mean particle size of the injected fuel is made a size in which the temperature of the fuel particles reaches the boiling point of the main fuel component, determined by the pressure in the combustion chamber, at substantially the top dead center of the compression stroke. After the injection and until about the top dead center of the compression stroke is reached, vaporization of the fuel by boiling from the fuel particles is prevented and the fuel of the fuel particles boils and vaporizes and is ignited and burnt after about the top dead center of the compression stroke.

12 Claims, 31 Drawing Sheets

COMPRESSION-IGNITION TYPE ENGINE

BACKGROUND OF THE INVENTION

1. Field of the Invention

The present invention relates to a compression-ignition type engine.

2. Description of the Related Art

In a usual compression-ignition type engine, fuel of a mean particle size of about 20 μm to 50 μm or less is injected into a combustion chamber after about 30 degrees before top dead center in the compression stroke. In such a compression-ignition type engine, part of the injected fuel is immediately vaporized just when the injection is begun. The succeeding fuel enters into the flame of combustion of the vaporized fuel and thus the injected fuel is successively burned. If the fuel entering into the flame of combustion is made to be successively burned in this way, however, the fuel will be burned in a state of air shortage, so a large amount of unburnt HC or soot will be generated.

In such a usual compression-ignition type engine, further, the fuel injection is formed in a limited region and therefore the combustion is performed in a limited region in the combustion chamber. If combustion is performed in such a limited region, however the local combustion temperature becomes higher than compared with the case where combustion is carried out in the entire interior of the combustion chamber, and accordingly a large amount of $NO_x$ is produced. Further, the smaller the mean particle size of the injected fuel, the greater the fuel vaporizing immediately upon injection, so the more severe the sudden pressure rise caused by the explosive combustion at the elapse of the ignition delay time after the start of the injection and as a result the higher the combustion temperature, so the still greater amount of $NO_x$ which is produced.

In this way, so long as the conventional combustion method is used, it is impossible to avoid the production of soot and $NO_x$. Accordingly it is necessary to make fundamental changes to the combustion method in order to prevent the generation of soot and $NO_x$.

Known in the art is a compression-ignition type engine wherein, in order to prevent the generation of the soot and $NO_x$, fuel is conically injected from a fuel injector arranged in the combustion chamber toward the top face of the piston, the mean particle size of the fuel droplets of the injected fuel is made larger than a predetermined particle size at which the temperature of the fuel droplets reaches the boiling point of the main component of the fuel at about the top dead center of the compression stroke, which boiling point is determined by the pressure in the combustion chamber, and the fuel injection is carried out during a predetermined period from the start of an intake stroke to about 60 degrees before top dead center of the compression stroke (refer to European Patent Publication No. 0639710).

In this engine, by conically injecting the fuel from the fuel injector toward the top face of the piston during the period from the start of the intake stroke at which the pressure in the combustion chamber is low to about 60 degrees before the top dead center of the compression stroke, the injected fuel is made to diffuse in the combustion chamber. Further, in this engine, most of the fuel droplets reach the boiling point after the top dead center of the compression stroke and thus the vaporization of the fuel droplets is started all at once after the top dead center of the compression stroke. When the diffused fuel droplets are vaporized all at once after the top dead center of the compression stroke in this way, a sufficient amount of air exists at the periphery of the fuel droplets, so the generation of soot is prevented, and, since the combustion temperature does not become extremely high, the generation of $NO_x$ is prevented.

In this engine, if the spread angle of the injected fuel is made small, when the fuel injection is carried out near 60 degrees before top dead center, that is, when the fuel injection is carried out when the piston position is relatively high, the injected fuel impinges upon and adheres to the top face of the piston. Accordingly, in this engine, the spread angle of the injected fuel is made considerably large in order to avoid this. When the spread angle of the injected fuel is made large in this way, when the fuel injection is carried out when the piston position is relatively high, since the pressure in the combustion chamber is relatively high, the injected fuel diffuses well in the entire interior of the combustion chamber without reaching the inner circumferential surface of the cylindrical bore, but when the fuel injection is carried out when the piston position is low, since the pressure in the combustion chamber is low at this time, the reach of the injected fuel becomes long, and thus the injected fuel impinges upon and adheres to the inner circumferential surface of the cylindrical bore. As a result, there is not only a problem of generation of a large amount of unburnt HC, but also a problem that the fuel is mixed into the lubricant oil.

SUMMARY OF THE INVENTION

An object of the present invention is to provide a compression-ignition type engine which is capable of reducing the amount of generation of $NO_x$ to almost zero while suppressing the generation of unburned HC.

According to the present invention, there is provided a compression-ignition type engine having a piston and a combustion chamber defined by the piston, the engine comprising injection means for conically injecting fuel in the combustion chamber toward a top face of the piston and forming fuel droplets dispersed in the combustion chamber, the mean value of the particle size of the fuel droplets being larger than a predetermined particle size at which the temperature of the fuel droplets having the predetermined particle size reaches a boiling point of a main component of the fuel, which boiling point is determined by pressure in the combustion chamber, at about the top dead center of the compression stroke; injection time control means for controlling the injection means to carry out an injecting operation at a predetermined timing during a period from the start of an intake stroke to approximately 60 degrees before top dead center of the compression stroke; and spread angle control means for controlling a spread angle of the conically injected fuel to make the spread angle smaller the closer in position the piston is to the bottom dead center when the fuel injection is carried out.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
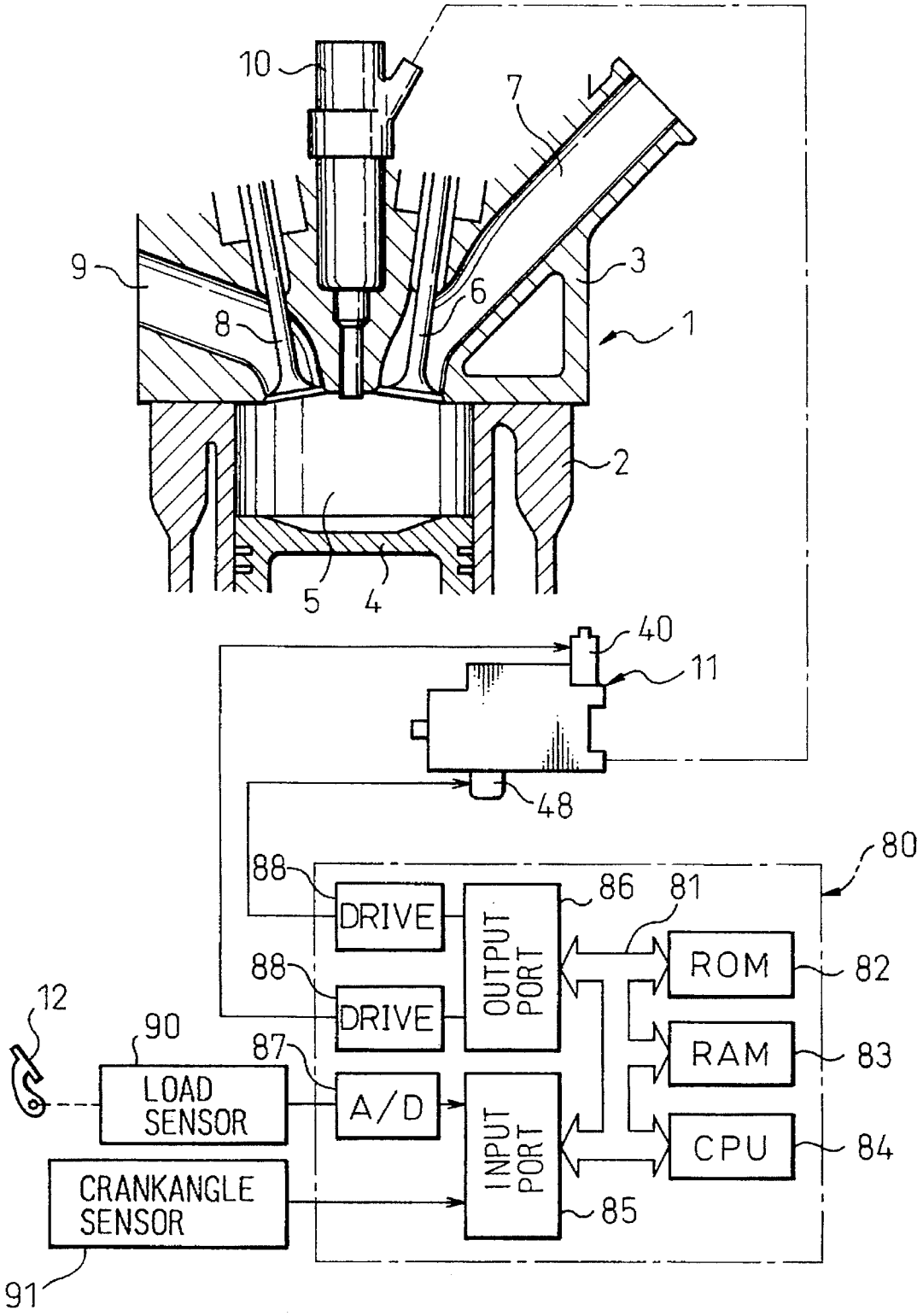
FIG. 1 is a side sectional view of a compression-ignition type engine.
Figure 2:
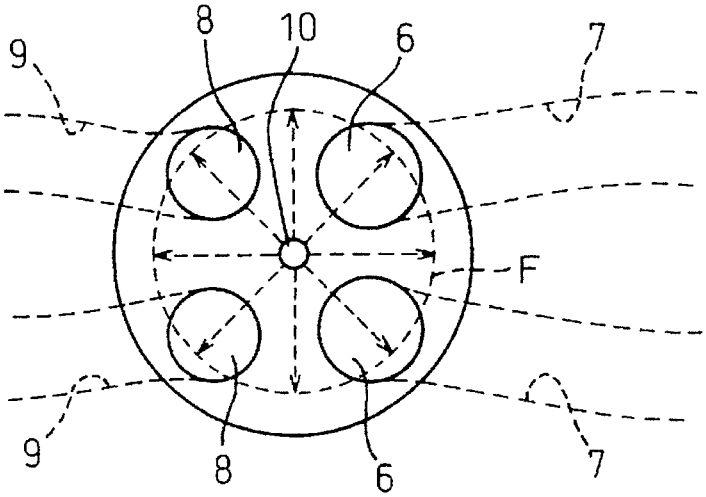
FIG. 2 is a bottom view of a cylinder head of FIG. 1.

FIGS. 1 and 2 show the case of application of the present invention to a four-stroke compression-ignition type engine.

Referring to FIG. 1 and FIG. 2, 1 designates an engine body, 2 a cylinder block, 3 a cylinder head, 4 a piston, 5 a combustion chamber, 6 a pair of intake valves, 7 a pair of intake ports, 8 a pair of exhaust valves, 9 a pair of exhaust ports, 10 a fuel injector arranged at the top center of the combustion chamber 5, and 11 an engine driven injection pump. The intake ports 7 are each comprised of a straight port extending substantially straight. Therefore, in the compression-ignition type engine shown in FIG. 1 and FIG. 2, a swirl cannot be produced in the combustion chamber 5 by the flow of air from the intake port 7 to the combustion chamber 5.

Figure 3:
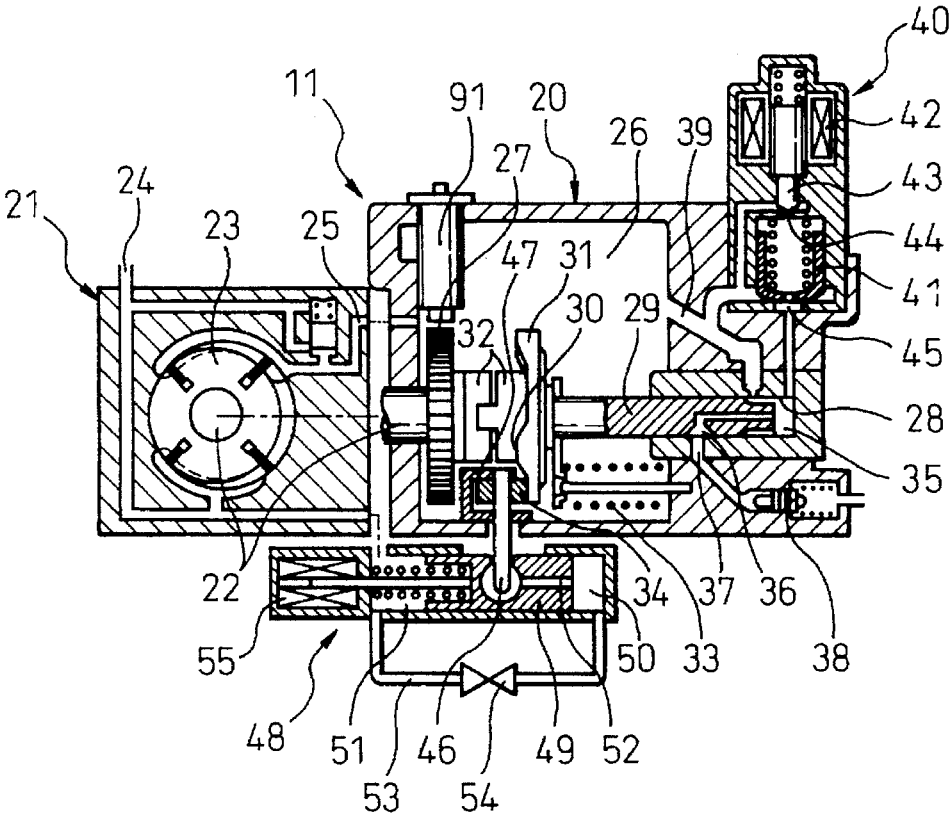
FIG. 3 is a side sectional view of an injection pump.

FIG. 3 is a side sectional view of the injection pump 11. Referring to FIG. 3, 20 is an injection pump body and 21 a fuel supply pump. To facilitate understanding of the structure, the fuel supply pump 21 is shown rotated 90 degrees. The fuel supply pump 21 has a rotor 23 attached on a drive shaft 22 driven by the engine. Fuel taken in from the fuel supply port 24 passes via the rotor 23 and is discharged from a fuel discharge port 25 to a fuel pressurizing chamber 26 in the injection pump body 20. The inside end of the drive shaft 22 projects out into the fuel pressurizing chamber 26. A gearwheel 27 is attached to the inside end of the drive shaft 22.

On the other hand, one end of a plunger 29 is inserted into the cylinder 28 formed in the fuel pump body 20. The other end of the plunger 29 is connected to a cam plate 31 formed with the same number of cam profiles 30 as the number of cylinders. The inside end of the drive shaft 22 is connected to the cam plate 31 through a coupling 32 able to transmit the rotational force. The cam plate 31 is pressed on a roller 34 by the spring force of a compression spring 33. When the drive shaft 22 turns and the cam profiles 30 of the cam plate 31 engage with the roller 34, the plunger 29 moves in the axial direction. Accordingly, the plunger 29 is made to rotate and move reciprocatively.

A pressurizing chamber 35 is formed at the front end of the plunger 29. Inside the plunger 29 are formed a fuel discharge port 36 and fuel spill port 36 communicating with the pressurizing chamber 35. Around the plunger 29 are formed the same number of fuel discharge passages 37 as the number of cylinders at equiangular intervals, which fuel discharge passages 37 can be aligned with the fuel discharge port 36. The fuel discharge passages 37 are connected with the corresponding fuel injectors 10 through a check valve 38. Note that, the fuel in the fuel pressurizing chamber 26 is fed into the pressurizing chamber 35 via a fuel supply passage 39.

On the other hand, this fuel supply passage 39 and the pressurizing chamber 35 are connected via a spill valve 40. This spill valve 40 is provided with a valve body 41 which is usually closed and a control valve 43 driven by a solenoid 42. When the solenoid 42 is deenergized, the control valve 43 closes the valve port 44, and at this time the valve body 41 closes the valve port 45. At this time, the fuel in the pressurizing chamber 35 is pressurized as the plunger 29 moves rightward. On the other hand, when the solenoid 42 is biased, the control valve 43 opens the valve port 44, and as a result the valve body 41 rises, so the valve port 45 is opened. As a result, the pressurized fuel in the pressurizing chamber 35 is spilled out into the fuel supply passage 39 via the valve port 45.

On the other hand, the support shaft 46 of the roller 34 is supported by a roller ring 47 rotatably arranged around the axial line of the drive shaft 22. This support shaft 46 is connected to a piston 49 of the timer device 48. Note that, to facilitate the understanding of the structure, this timer device 48 is also shown rotated 90 degrees. A high pressure chamber 50 and a low pressure chamber 51 are formed on both sides of the piston 49 in this timer device 48. The high pressure chamber 50 is connected to the interior of the fuel pressurizing chamber 26 via a communication passage 52 formed in the piston 49, and the low pressure chamber 51 is connected to the fuel supply port 24. These high pressure chamber 50 and low pressure chamber 51 are communicated with each other via a communication pipe 53. A communication control valve 54 is arranged in this communication pipe 53. Also, in the piston 49 is attached a piston position detection sensor for detecting the position of the piston 49.

Figure 4:
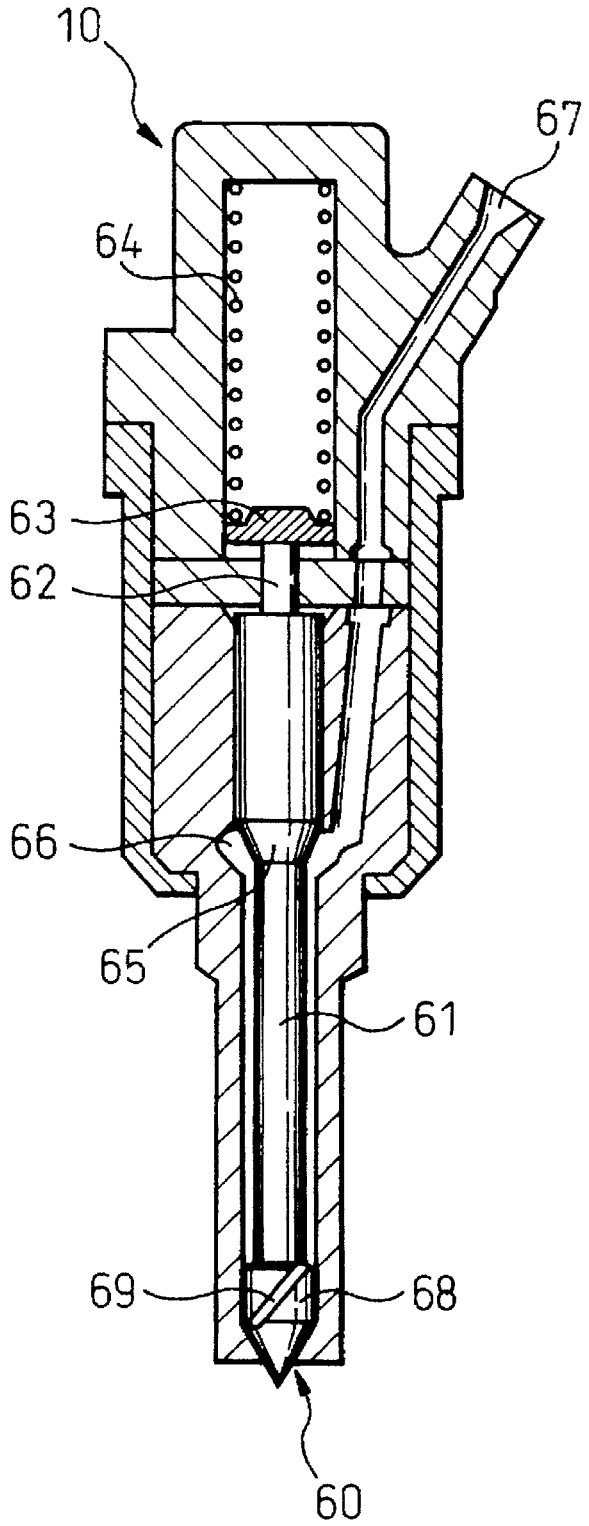
FIG. 4 is a side sectional view of a fuel injector.

FIG. 4 is a side sectional view of the fuel injector 10. Referring to FIG. 4, 60 designates a nozzle port, 61 a needle performing the opening and closing control of the nozzle port 60, 62 a pressurizing pin, 63 a spring retainer, and 64 a compression spring. The needle 61 is biased in a valve opening direction by the spring force of the compression spring 64. The needle 4 has a pressure receiving surface 65 exhibiting a conical shape. A fuel reservoir 66 formed around this pressure receiving surface 65 is connected to the fuel supply port 67 on the one hand and connected to the nozzle port 60 on the other hand. The fuel discharged from the fuel pump 11 is supplied to the fuel supply port 67. A cylindrical large diameter portion 68 is formed in a bottom end of the needle 60, and an obliquely extending fuel communication groove 69 is formed on the outer circumferential surface of this large diameter portion 68.

In FIG. 3, when the cam profiles of the cam plate 31 engage with the roller 34, the plunger 29 is moved rightward. At this time, when the spill valve 40 is closed, the fuel pressure in the pressurizing chamber 35 is pressurized, and this pressurized fuel is supplied to the fuel injector 10. Subsequently when the fuel pressure acting upon the pressure receiving surface 65 of the needle 61 (FIG. 4) becomes higher than the spring force of the compression spring 64, the needle 61 rises, and the fuel injection from the fuel injector 10 is started. At this time, the fuel is given a swirling force when passing the fuel communication groove 69, and thus the fuel is conically injected from the nozzle port 60 while swirling. Subsequently when the spill valve 40 is opened, the fuel pressure in the pressurizing chamber 35 is rapidly lowered, and thus the fuel injection from the fuel injector 10 is stopped.

On the other hand, the communication control valve 54 of the timer device 48 shown in FIG. 3 is controlled in the ratio of the opening time, that is, the duty ratio. When the communication control valve 54 is retained in the closed state, the fuel pressure in the high pressure chamber 50 is the highest. As the ratio of the opening time of the communication control valve 54, that is, the duty ratio, becomes larger, the fuel pressure in the high pressure chamber 50 is gradually lowered. When the fuel pressure in the high pressure chamber 50 is lowered, the piston 60 moves rightward in FIG. 3, and as a result, the roller ring 47 is pivoted in an opposite direction to the rotation direction of the cam plate 31. Thus, the timing at which the plunger 29 starts to move rightward is made earlier. In the embodiment shown in FIG. 1, the fuel injection timing and the fuel injection amount are controlled by the timer device 48 and the spill valve 40.

Referring to FIG. 1 again, an electronic control unit 80 is comprised of a digital computer and is provided with a read only memory (ROM) 82, random access memory (RAM) 83, microprocessor (CPU) 84, input port 85, and output port 86 connected to each other through a bidirectional bus 81. In the accelerator pedal 12 is attached a load sensor 90 for generating an output voltage proportional to the amount of depression of the accelerator pedal 12, which output voltage is input through an AD converter 87 to the input port 85. Further, as shown in FIG. 3, a crank angle sensor 91 comprised of a magneto-electric pick-up is arranged facing the outer circumferential surface of the gear wheel 27. The output signal of this crank angle sensor is input to the input port 85. The current crank angle and engine rotational speed are calculated from the output of the crank angle sensor 91. On the other hand, the output port 86 is connected to the solenoid 42 of the spill valve 40 and the communication control valve 54 of the timer device 48 via the corresponding drive circuit 88.

Next, an explanation will be made of a fundamental method of combustion which can reduce the amount of generation of soot and $NO_x$ to substantially zero while referring to FIG. 5 to FIG. 8. Note that for this method of combustion, the explanation will be made focusing on the time of high load operation, when the generation of soot and $NO_x$ are most likely to occur.

In the past, in so far as injection was performed atomizing the fuel to give a mean particle size of the fuel particles of not more than 50 μm, no matter what the injection timing was set at and no matter what the fuel injection pressure was set at, it was difficult to simultaneously reduce the soot and $NO_x$. On top of this, it was impossible to reduce the generation of soot and $NO_x$ to substantially zero. This was because there were fundamental problems in the conventional method of combustion. That is, there may be considered to be two major factors making the simultaneous reduction of soot and $NO_x$ difficult in the conventional method of combustion. One of these was that part of the fuel is immediately vaporized just when the fuel is injected and this vaporized fuel causes rapid combustion to commence early. The other is that even if it is attempted to diffuse the fuel uniformly throughout the entire inside of the combustion chamber, the fuel in fact does not uniformly diffuse throughout the entire inside of the combustion chamber, but ends up gathering inside a limited region in the combustion chamber or else even if the fuel diffuses throughout substantially all the inside of the combustion chamber, an overly rich region and lean region exist.

That is, as explained above, if the combustion starts immediately after the start of the injection, the following injected fuel plunges into the flame of combustion and therefore this injected fuel ends up burned in a state of insufficient air and accordingly soot is produced. Further, if an overly rich air fuel mixture is formed in the combustion chamber, the combustion of this overly rich air-fuel mixture also causes generation of soot. On the other hand, if the injected fuel gathers in a limited region in the combustion chamber and this gathered fuel is burned, the combustion temperature inside the region will become higher than the combustion temperature in the case of diffusion of the fuel in the combustion chamber and accordingly $NO_x$ will be generated. Further, if the injected fuel is rapidly burnt early and the combustion pressure rapidly rises, the combustion temperature will further rise and accordingly further $NO_x$ will be generated.

Therefore, it has become clear that it would be possible to simultaneously reduce the soot and $NO_x$ by eliminating the above two factors, that is, preventing the early vaporization of injected fuel after injection and ensuring a uniform diffusion of the injected fuel in the combustion chamber. In this case, it would be possible to simultaneously reduce the amount of generation of soot and $NO_x$ to substantially zero by making the mean particle size of the injected fuel greatly larger than the mean particle size used in the conventional method of combustion and by making the injection timing considerably earlier than the injection timing usually used in the conventional method of combustion. This will be explained below.

Figure 5:
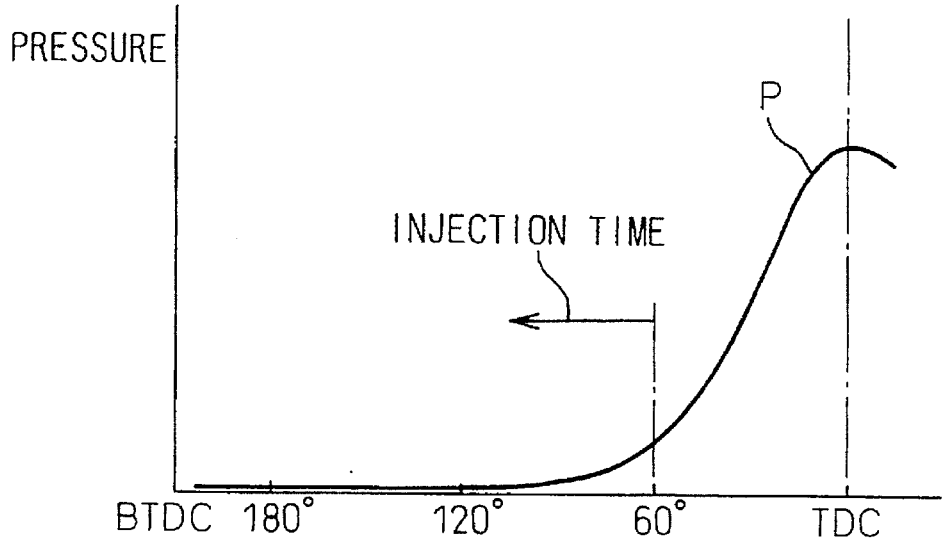
FIG. 5 is a view of the changes in pressure in the combustion chamber caused by just the compression action of a piston.

The curve in FIG. 5 shows the changes in the pressure P in the combustion chamber 5 caused by just the compression action of the piston 4. As will be understood from FIG. 5, the pressure P in the combustion chamber 5 rises sharply once past approximately 60 degrees before top dead center BTDC of the compression stroke. This is regardless of the time of opening of the intake valve 6. No matter what reciprocating type internal combustion engine, the pressure P in the combustion chamber 5 changes as shown in FIG. 5.

Figure 6:
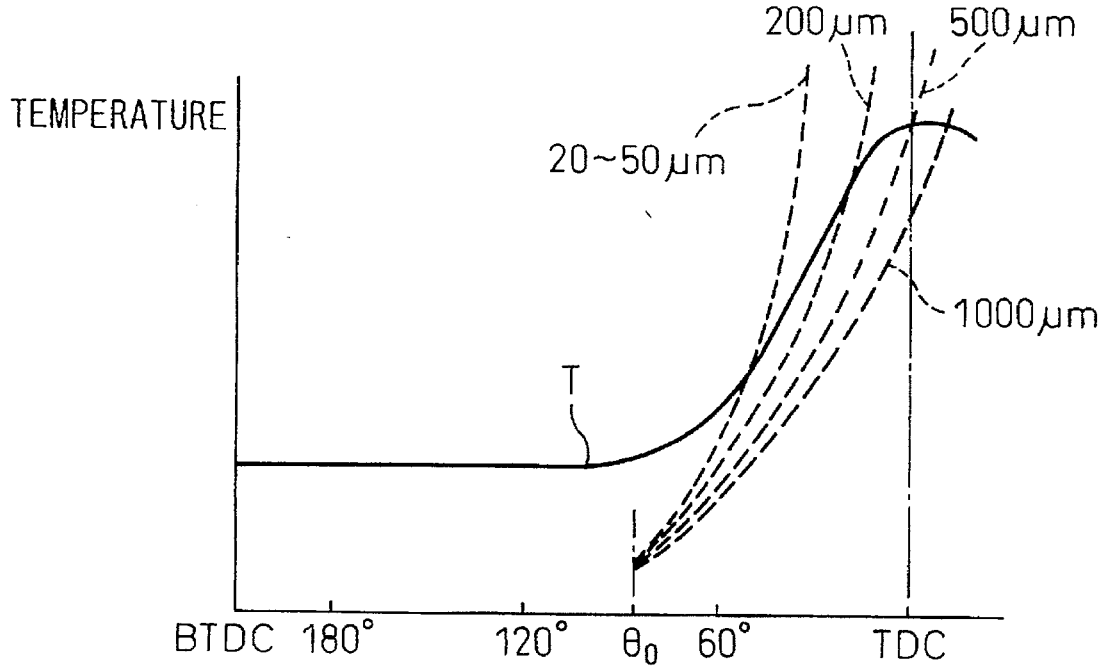
FIG. 6 is a view of the boiling point and the changes in temperature of the fuel particles.

The curve shown by the solid line in FIG. 6 shows the boiling temperature of the fuel, i.e., the boiling point T at the different crank angles. If the pressure P in the combustion chamber 5 rises, the boiling point T of the fuel also rises along with it, so the boiling point T of the fuel also rises sharply once past approximately 60 degrees before top dead center BTDC of the compression stroke. On the other hand, the broken lines in FIG. 6 show the differences in the changes in temperature of the fuel particles caused by the differences of the particle size of the fuel particles upon injection at $\theta_0$ degrees before top dead center BTDC of the compression stroke. The temperature of the fuel particles just after injection is lower than the boiling point T determined by the pressure at that time. Next, the fuel particles receive the heat from the surroundings and rise in temperature. The rate of rise of temperature of the fuel particles at this time becomes faster the smaller the particle size.

That is, if it is assumed that the particle size of the fuel particles is from about 20 μm to 50 μm, the temperature of the fuel particles rises rapidly after injection and reaches the boiling point T at a crank angle far before the top dead center TDC of the compression stroke, and the rapid vaporization action of the fuel due to the boiling from the fuel particles is started. Further, as will be understood from FIG. 6, even when the particle size of the fuel particles is 200 μm, the temperature of the fuel particles reaches the boiling point T before the top dead center TDC of the compression stroke is reached and a rapid vaporization action of the fuel is started by the boiling. When the rapid vaporization action of the fuel is started by boiling before the top dead center TDC of the compression stroke is reached in this way, an explosive combustion occurs due to the fuel which vaporized at this time and accordingly a large amount of soot and $NO_x$ is generated as mentioned earlier.

As opposed to this, if the size of the fuel particles becomes larger than about 500 μm, the rate of rise of the temperature of the fuel particles becomes slower, so the temperature of the fuel particles will not reach the boiling point T until approximately the top dead center TDC of the compression stroke or later. Accordingly, by making the size of the fuel particles larger than about 500 μm, there is no rapid vaporizing action of the fuel due to boiling before approximately the top dead center TDC of the compression stroke is reached and the rapid vaporizing action of the fuel due to the boiling is started at approximately the top dead center TDC of the compression stroke or after the top dead center TDC of the compression stroke.

Note that in actuality the fuel includes various components with different boiling points and that when one speaks of the "boiling point" of the fuel, there are a number of boiling points. Accordingly, when considering the boiling point of fuel, it is said to be preferable to consider the boiling point of the main component of the fuel. Further, the particle size of the injected fuel is never going to be completely uniform, so when considering the particle size of the injected fuel, it is said to be preferable to consider the mean particle size of the injected fuel. If considered in this way, by making the mean particle size of the injected fuel not less than a particle size whereby the temperature of the mean size fuel particles reaches the boiling point T of the main component of the fuel, determined by the pressure at that time, at about the top dead center TDC of the compression stroke or after the top dead center TDC of the compression stroke, there will be no rapid vaporization of fuel caused by boiling from the fuel particles until after injection when about the top dead center TDC of the compression stroke is reached and the rapid vaporization caused by boiling from the fuel particles will occur after about the top dead center TDC of the compression stroke.

Figure 7A:
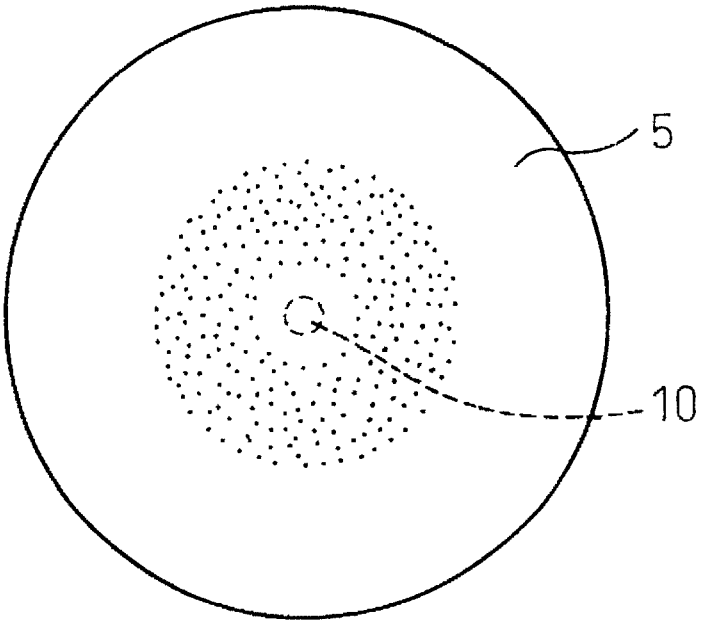
FIGS. 7A and 7B are views of the distribution of fuel particles.

Note that in this case, the rapid vaporizing action of the fuel caused by the boiling is started substantially simultaneously in all fuel particles and the fuel from all fuel particles is ignited and started to be burned all at once. At this time, as shown in FIG. 7A, if the fuel particles were to collect at a part in the combustion chamber 5, then there would be insufficient air around the individual fuel particles, so the fuel particles would be made to be burned in a state of insufficiency of air and accordingly soot would be produced. To prevent the generation of soot in this way, when the fuel is ignited, it is preferable that all the fuel particles diffuse throughout the inside of the combustion chamber 5 as shown in FIG. 7B with a sufficient distance between fuel particles so that sufficient air is present around the fuel particles at the time of ignition of the fuel.

Figure 7B:
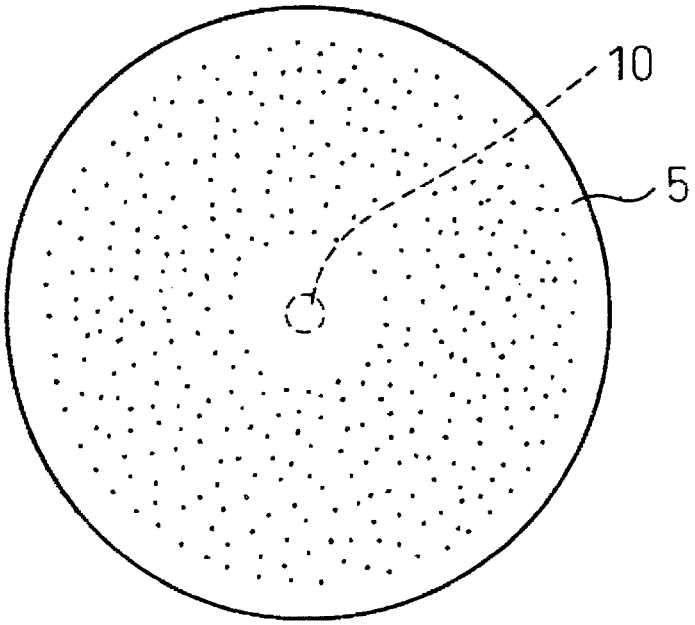

As shown in FIG. 7B, for the fuel particles to diffuse throughout the inside of the combustion chamber 5 at the time of ignition, the fuel must be injected from the fuel injector 10 when the pressure P in the combustion chamber 5 is low. That is, if the pressure P in the combustion chamber 5 becomes high, the air resistance becomes larger, so the distance of flight of the injected fuel becomes shorter and accordingly at this time the fuel particles cannot spread throughout the inside of the combustion chamber 5 as shown in FIG. 7A. As explained before, the pressure P inside the combustion chamber 5 rapidly rises and becomes high once past about 60 degrees before top dead center BTDC of the compression stroke and in actuality if fuel is injected past about 60 degrees before top dead center BTDC of the compression stroke, then the fuel particles will not sufficiently spread in the combustion chamber 5 as shown in FIG. 7A. As opposed to this, before about 60 degrees before top dead center BTDC of the compression stroke, the pressure P inside the combustion chamber 5 is low and therefore if the fuel injection is performed before about 60 degrees before top dead center BTDC of the compression stroke, the fuel particles will diffuse throughout the inside of the combustion chamber 5 as shown in FIG. 7B at the time of ignition. Note that in this case, so long as the timing of injection of fuel is made before about 60 degrees before top dead center BTDC of the compression stroke, either the compression stroke or intake stroke is acceptable.

In this way, by injecting the fuel before about 60 degrees before top dead center BTDC of the compression stroke and making the mean particle size of the fuel injected at this time a size whereby the temperature of the mean size fuel particles reaches the boiling point T of the main fuel component, determined by the pressure at that time, at about the top dead center TDC of the compression stroke or after the top dead center TDC of the compression stroke, there will be no rapid vaporization of the fuel caused by boiling from the fuel particles after injection until about the top dead center TDC of the compression stroke is reached and the rapid vaporization of the fuel due to boiling from the fuel particles will start after about the top dead center TDC of the compression stroke. At this time, the fuel particles diffuse throughout the entire interior of the combustion chamber 5 as shown in FIG. 7B.

If the vaporization of the fuel from the fuel particles is started, the fuel vaporized from the fuel particles can be ignited and burnt all at once. At this time, there is sufficient air around the individual fuel particles, so soot is not generated and further combustion is performed throughout the combustion chamber 5, so the combustion temperature becomes low and accordingly there is no $NO_x$ generated. Further, if there arises a time difference in the start of the combustion by the individual fuel particles, the heat of combustion of the previous burnt fuel heats the combustion gas of the later burnt fuel, so the combustion gas temperature becomes higher and $NO_x$ ends up being generated. As mentioned above, however, the fuel vaporized from the individual fuel particles starts to be burned at substantially the same time, so in that sense too there is no generation of $NO_x$. This is the fundamental method of combustion used in the present invention.

Figure 8:
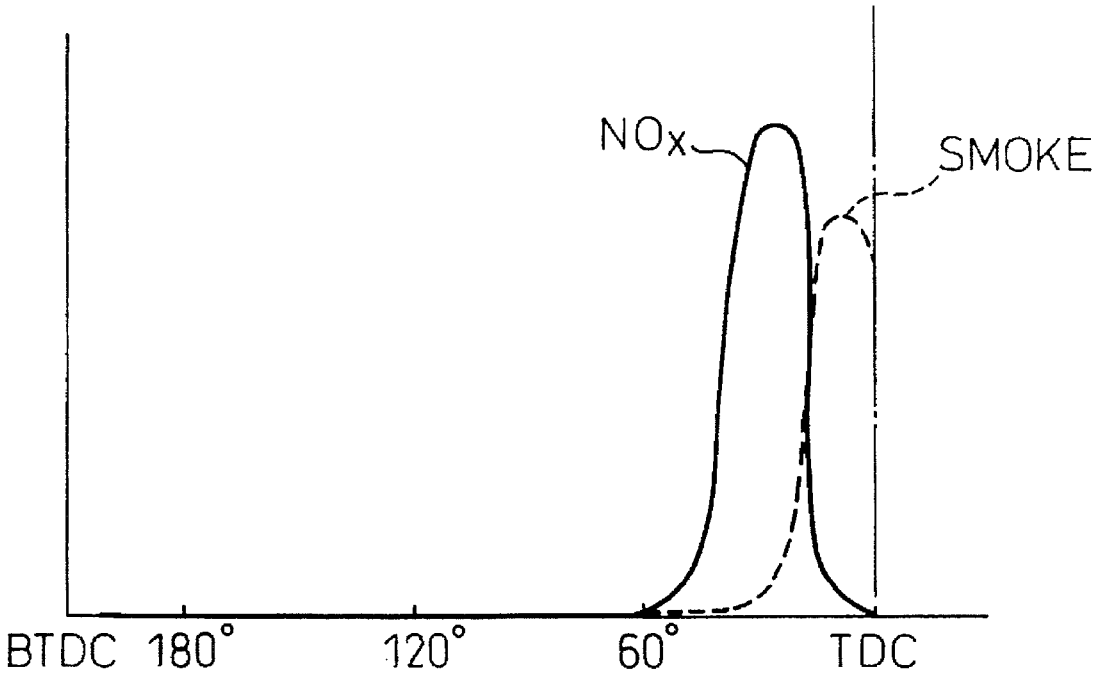
FIG. 8 is a view of the amount of generation of smoke and $NO_x$.

FIG. 8 shows the results of experiments where this fundamental method of combustion is carried out. FIG. 8 shows the amount of generation of soot, that is, the smoke, and the amount of generation of $NO_x$ in the case of a fuel injection pressure of 20 MPa, an engine operation speed of 1000 rpm, an amount of fuel injection of 15 $mm^3$, and different injection timings. If the fuel injection timing is set to be before about 60 degrees before top dead center BTDC of the compression stroke, surprising it was learned that no smoke or $NO_x$ is generated at all.

The important point in this method of combustion is the diffusion of fuel having relatively a large particle size throughout the entire interior of the combustion chamber 5 without impingement and adhesion of the injected fuel to the inner wall surface of the cylinder bore, while spacing the individual fuel particles. Namely, if the fuel injection is carried out at a relatively low pressure so that the particle size of the injected fuel becomes larger, even if the injection pressure is low, the inertial force of the fuel particles becomes large, so the fuel particles reach the inner wall surface of the cylinder bore and become easily adhered to the inner wall surface of the cylinder bore. When the injected fuel is adhered to the inner wall surface of the cylinder bore, a large amount of unburnt HC is generated, and further the lubricant oil is diluted by fuel, so it is necessary to prevent the injected fuel from being adhered to the inner wall surface of the cylinder bore.

Figure 9A:
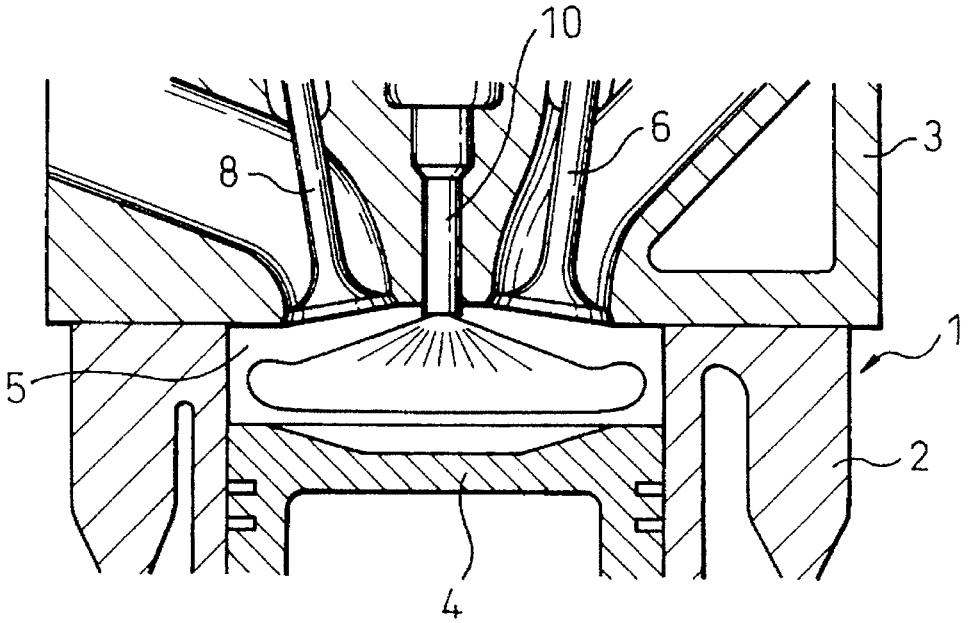
FIGS. 9A and 9B are views of relationships between a spread angle of the injected fuel and the position of the piston.
Figure 9B:
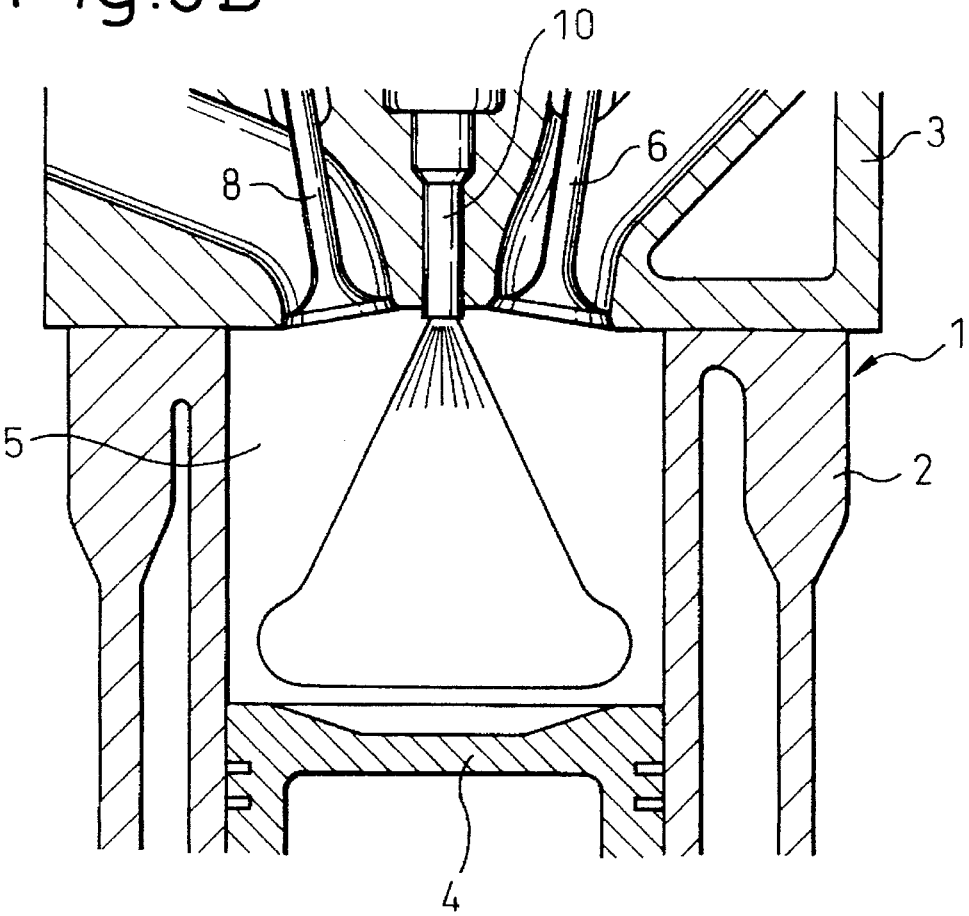

Therefore, in the present invention, if the fuel injection is carried out when the position of the piston 4 is relatively high, as shown in FIG. 9A, the spread angle of the injected fuel is made larger, and if the fuel injection is carried out when the position of the piston 4 is low, as shown in FIG. 9B, the spread angle of the injected fuel is made smaller. Namely, when the position of the piston 4 is low as shown in FIG. 9B, the pressure in the combustion chamber 4 is low, and therefore if the fuel injection is carried out at this time, the reach of the fuel particles becomes long. Accordingly, when the spread angle of the injected fuel is made larger at this time as shown in FIG. 9A, the injected fuel ends up impinging upon and adhering to the inner wall surface of the cylinder bore. At this time, when the spread angle of the injected fuel is made small as shown in FIG. 9B, however, even if the reach of the fuel particles becomes long, the injected fuel no longer impinges upon the top face of the piston 4. In addition, if the spread angle of the injected fuel is made small at this time, as will be understood from FIG. 9B, the fuel particles can be diffused throughout the entire interior of the combustion chamber 5.

As opposed to this, if the position of the piston 4 is high as shown in FIG. 9A, the pressure in the combustion chamber 4 becomes higher than compared with the case where the position of the piston 4 is low, and therefore if the fuel injection is carried out at this time, the reach of the fuel particles becomes shorter. Accordingly, at this time, as shown in FIG. 9A, even if the spread angle of the injected fuel is made larger, the injected fuel does not impinge upon and adhere to the inner wall surface of the cylinder bore. In addition, at this time, when the spread angle of the injected fuel is made larger, as will be understood from FIG. 9A, the injected fuel can be diffused throughout the entire interior of the combustion chamber 5 without impinging upon the top face of the piston 4. Accordingly, in order to diffuse the fuel particles throughout the entire interior of the combustion chamber 5 without adhesion of the injected fuel to the inner wall surface of the cylinder bore and the top face of the piston 4, it becomes necessary to reduce the spread angle of the injected fuel smaller as the position of piston 4 is closer to the bottom dead center.

An explanation will be made next of the method for control of the spread angle of the injected fuel for varying the spread angle of the injected fuel according to the fuel injection timing.

FIG. 10 to FIG. 17 show a first embodiment of the method for the control of the spread angle of the injected fuel using the fuel injector 10 shown in FIG. 4. In the fuel injector 10 shown in FIG. 4, the higher the fuel injection pressure, the stronger the swirl force given to the fuel spilled out of the nozzle port 60, and therefore the higher the fuel injection pressure, the larger the spread angle of the injected fuel. Accordingly, in this first embodiment, the closer the position of the piston 4 to the bottom dead center when the fuel injection is carried out, the lower the fuel injection pressure is made, whereby the closer the position of the piston 4 to the bottom dead center when the fuel injection is carried out, the smaller the spread angle of the injected fuel is made.

Figure 10:
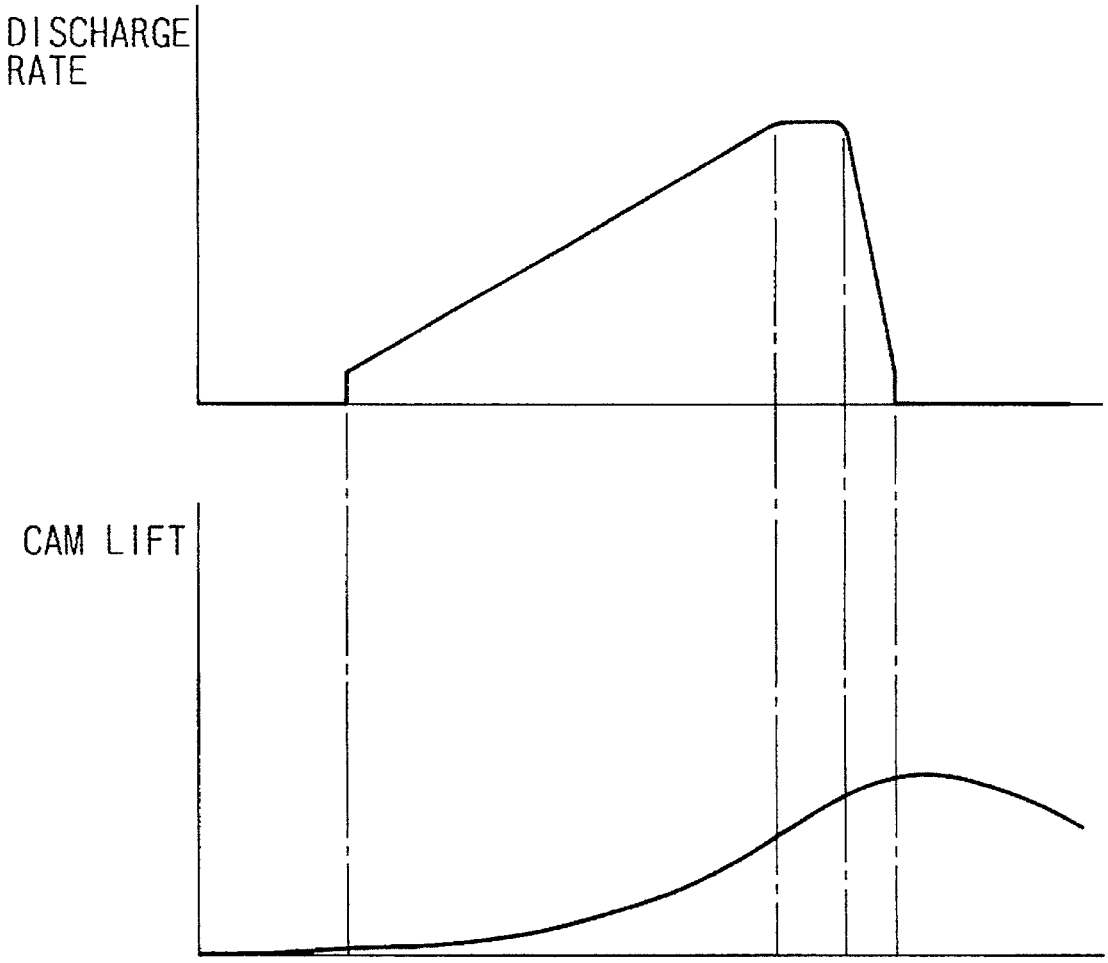
FIG. 10 is a view of relationships between a cam lift and a discharge rate of the fuel.

FIG. 10 shows relationships between the cam lift of the cam profiles 30 of the cam plate 31 shown in FIG. 3 and the discharge rate of fuel supplied from the injection pump 11 to the fuel injector 10. Here, the discharge rate of the fuel represents the amount of the fuel supply per predetermined crank angle. Note that, FIG. 10 shows a case where all fuel pressurized by the plunger 29 is supplied to the fuel injector 10. As shown in FIG. 10, in the first embodiment, the shape of the cam profiles 30 is determined so that the discharge rate rises with almost a constant proportion as the cam plate 31 rotates. In this case, the higher the fuel discharge rate, the larger the fuel amount supplied to the fuel injector 10 during the time of the predetermined crank angle, so the higher the fuel discharge rate, the higher the fuel injection pressure.

Figure 11:
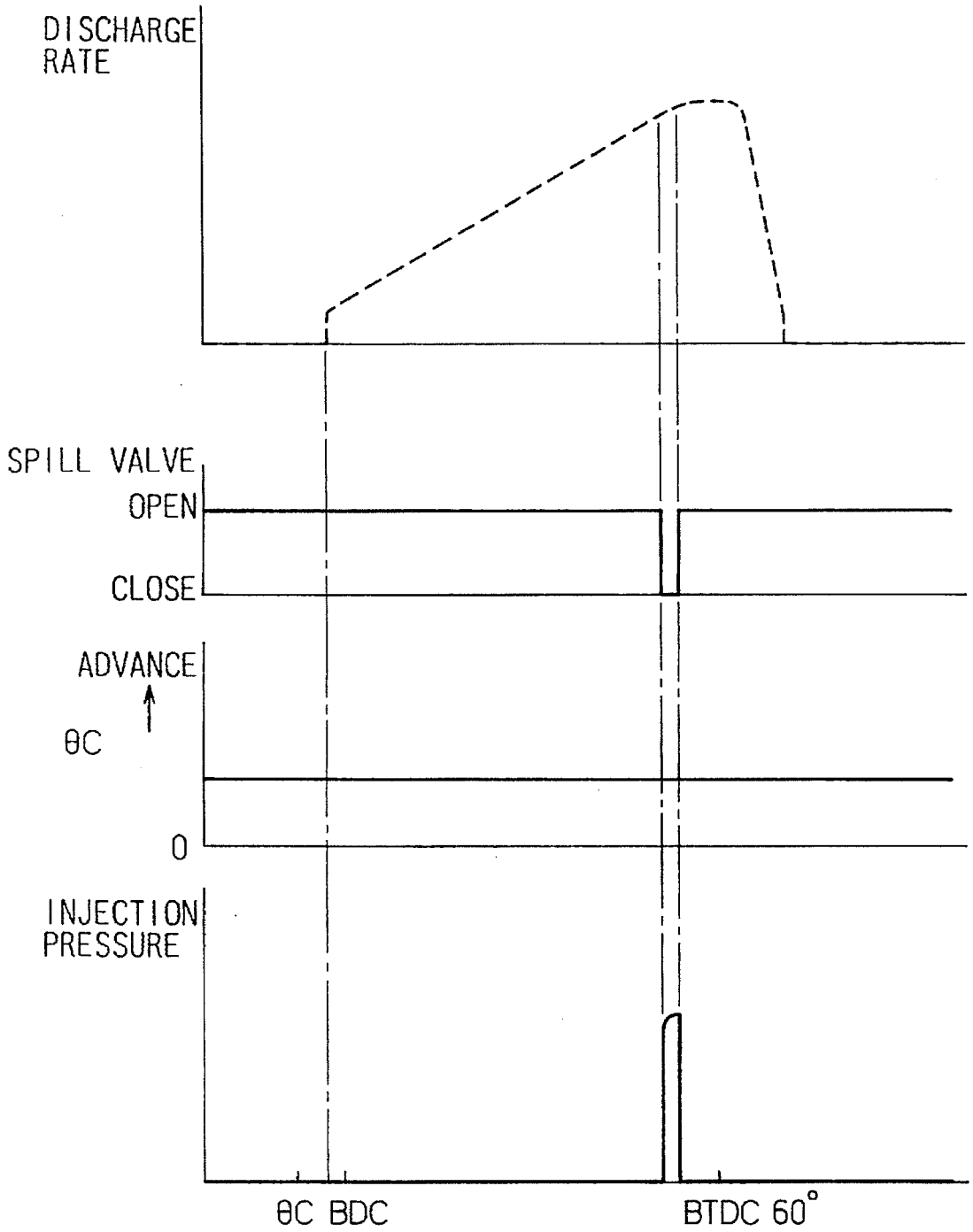
FIGS. 11 and 12 are views for explaining an injection control at the time of low and high engine load operation, respectively.

FIG. 11 shows an opening and closing control of the spill valve 40 at the time of low engine load operation, a timing θC when the plunger 29 starts to move rightward in FIG. 3 (hereinafter, referred to as a plunger movement start timing θC), and a fuel injection pressure. The plunger movement start timing θC is controlled by the timer device 48. At the time of the low engine load operation as shown in FIG. 11, the plunger movement start timing θC is made slightly earlier. The spill valve 40 is opened until the crank angle approaches 60 degrees before the top dead center (BTDC 60°) as shown in FIG. 11, and therefore the fuel injection action is not carried out during this time. Subsequently, when the crank angle approaches BTDC 60°, the spill valve 40 is closed, and thus the fuel injection from the fuel injector 10 is started. At this time, the discharge rate of the injection pump 11 is high, and therefore when the spill valve 40 is closed, the injection pressure rapidly rises and the fuel injection is carried out with a high fuel injection pressure. As a result, as shown in FIG. 9A, the spread angle of the injected fuel becomes large.

Figure 12:
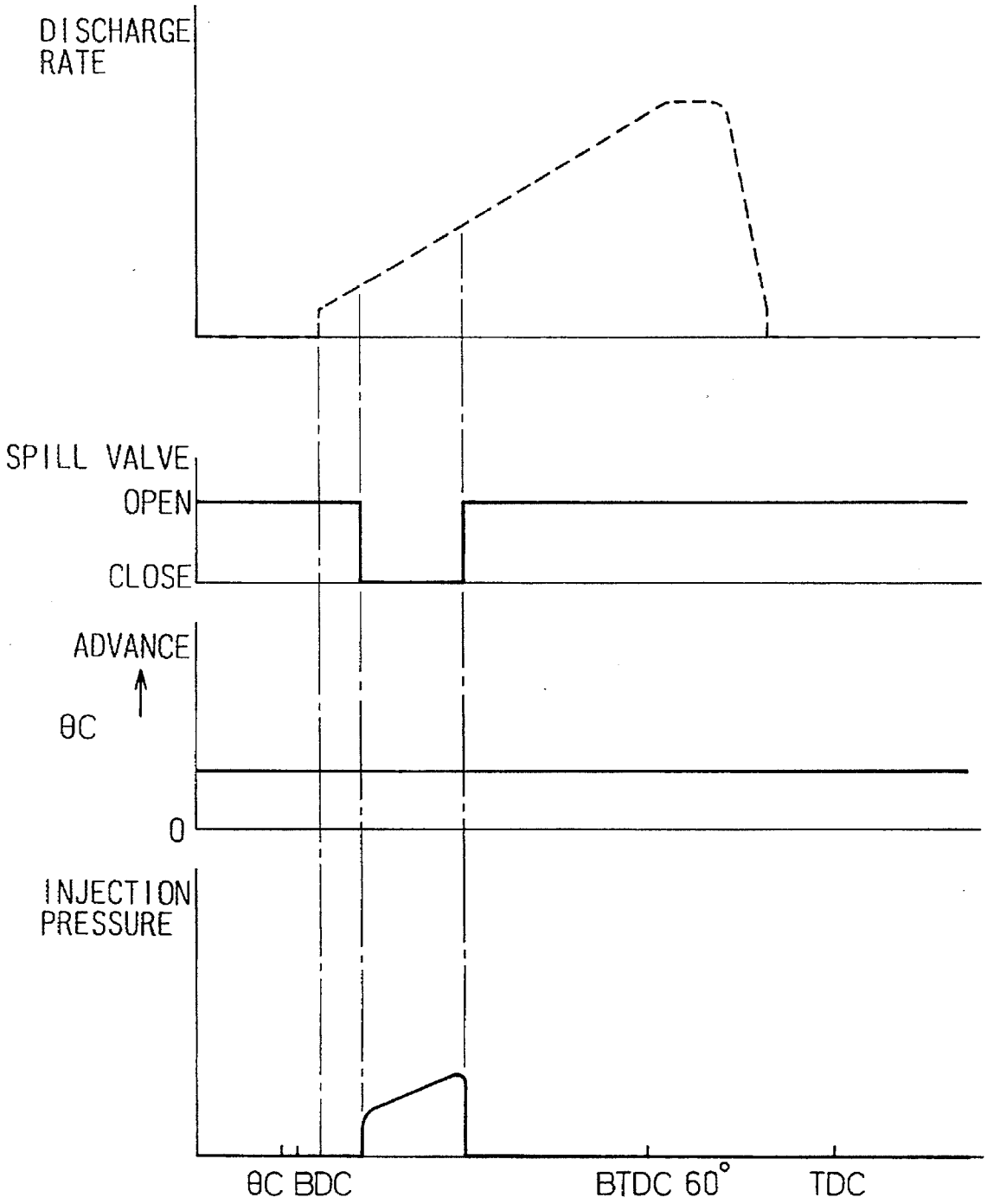

On the other hand, at the time of a high engine load operation, when the crank angle goes past the bottom dead center (BTC) as shown in FIG. 12, the spill valve 40 is closed, and the fuel injection is started. At this time, the discharge rate of the injection pump 11 is low, so the fuel injection pressure does not becomes so high, and thus the spread angle of the injected fuel becomes small as shown in FIG. 9B. Further, the higher the position of the piston, the higher the fuel injection pressure, so the higher the position of the piston 4, the larger the spread angle of the injected fuel. That is, along with the change of the position of the piston 4, the spread angle of the injected fuel is continuously changed. Note that, as will be understood from FIG. 12, at the time of the high engine load operation, the plunger movement start timing θC is slightly delayed in angle compared with that at the time of the low engine load operation.

Figure 13:
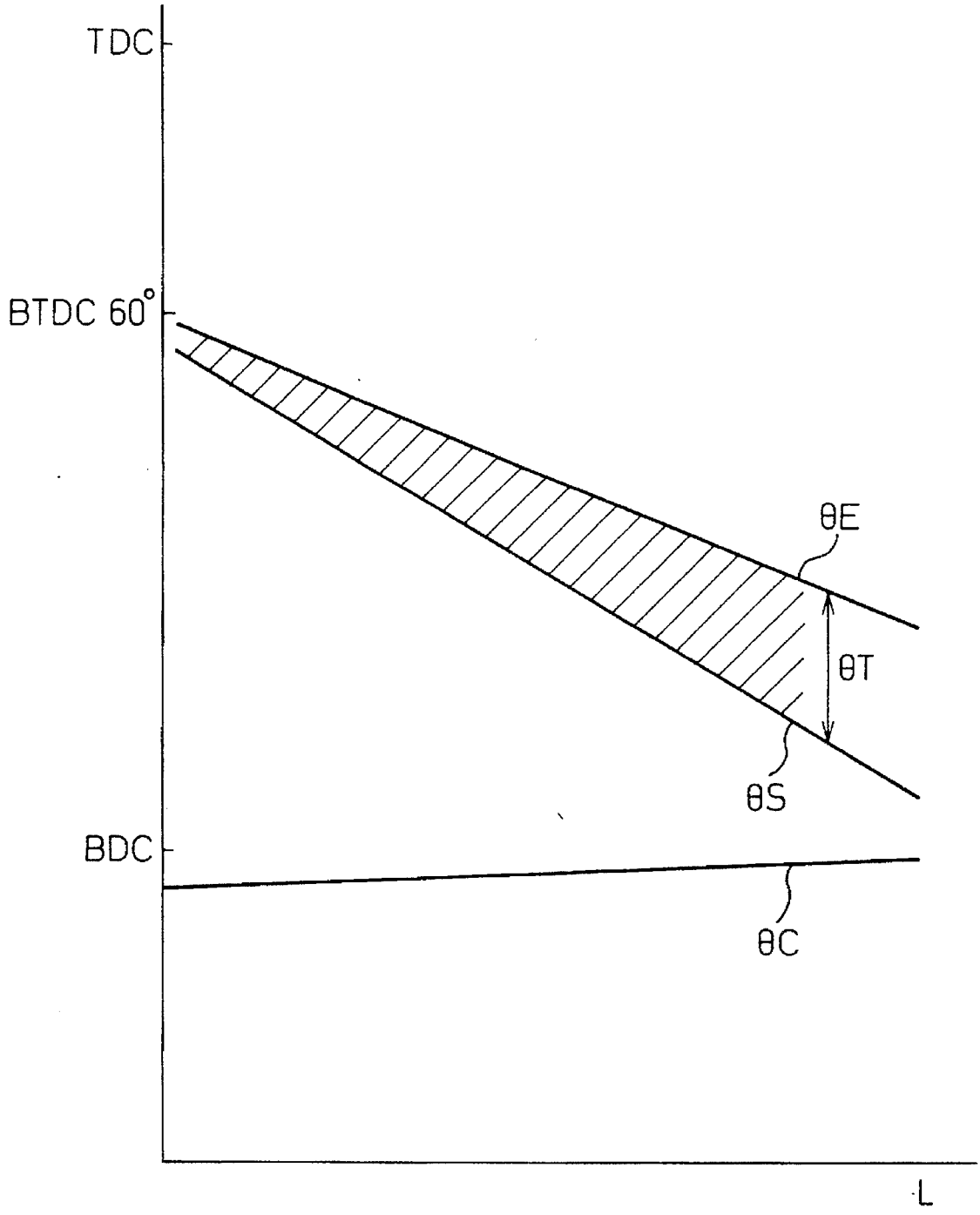
FIG. 13 is a view of an injection timing etc.

FIG. 13 shows relationships among an injection start timing θS, injection completion timing θE, injection period θT, plunger movement start timing θC, and a depression amount L of the accelerator pedal 12. As shown in FIG. 13, the larger the depression amount L of the accelerator pedal 12, that is, the higher the engine load, the earlier the injection start timing θS. The plunger movement start timing θC becomes slightly slower as the engine load becomes higher. Further, the higher the engine load, the smaller the spread angle of the injected fuel, whereby the fuel particles can be diffused throughout the entire interior of the combustion chamber 5 even if the engine load is high. As a result, even if the fuel is slightly vaporized just after injection, the vaporized fuel is diffused throughout the entire interior of the combustion chamber 5, and therefore ignition is not caused and thus knocking can be prevented.

Figure 14A:
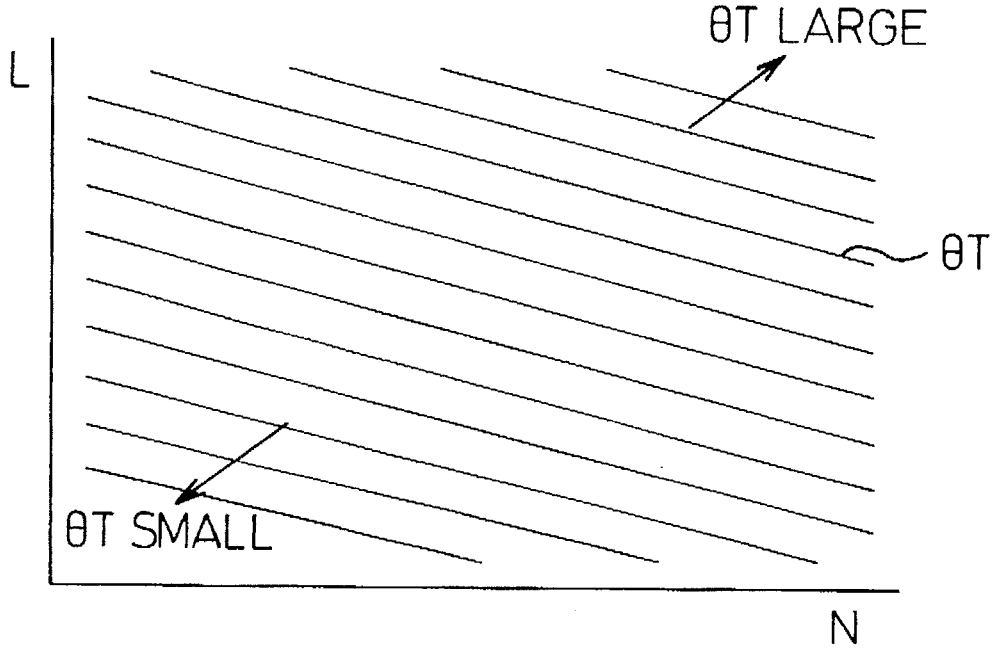
FIGS. 14A and 14B are views of an injection time θT.
Figure 15A:
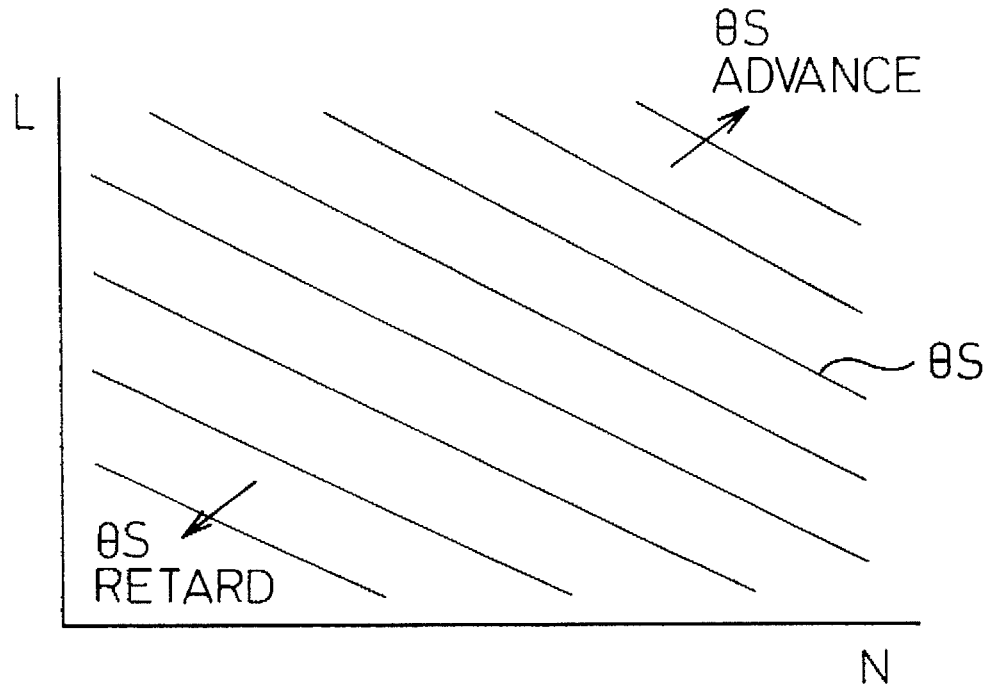
FIGS. 15A and 15B are views of an injection start timing θS.
Figure 15B:
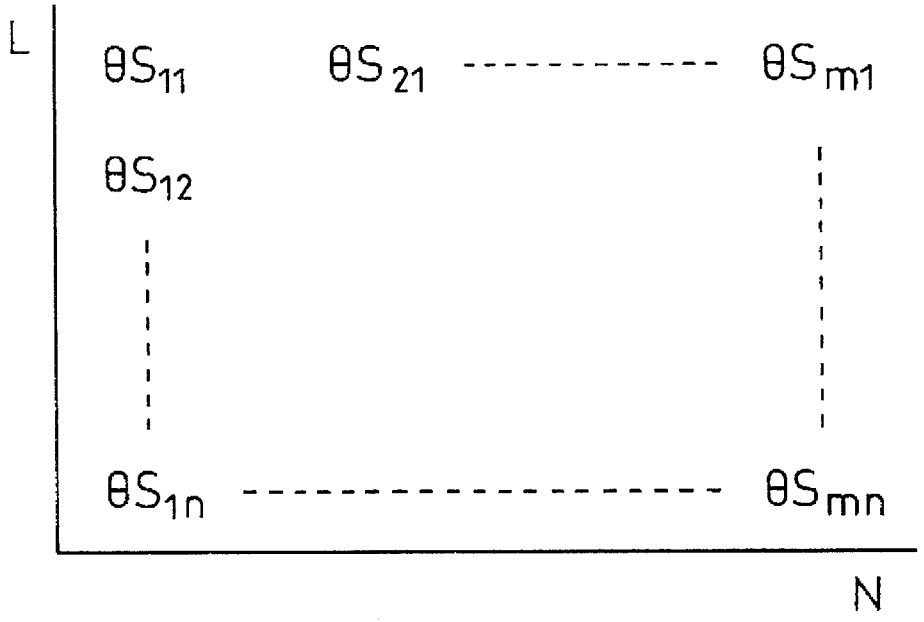
Figure 16:
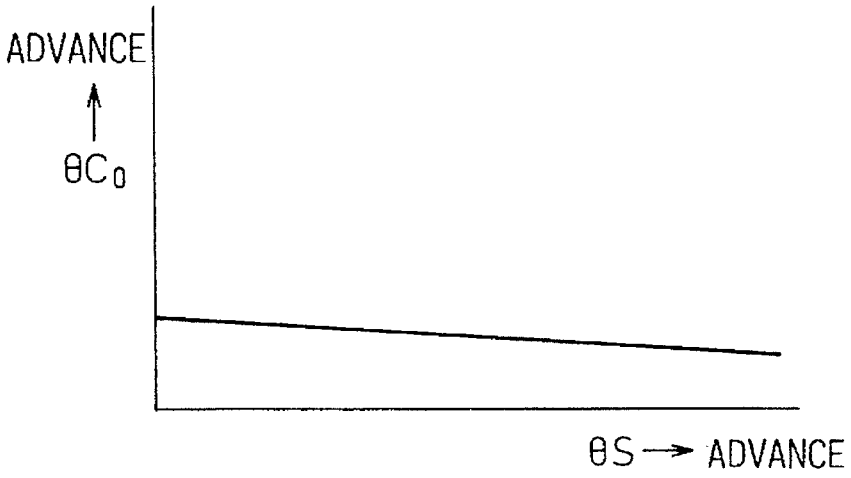
FIG. 16 is a view of relationships between a target value $\theta C_0$ of the plunger movement start timing and the injection start timing θS.

In FIG. 13, the injection period θT indicated by the hatching becomes longer as the depression amount L of the accelerator pedal 12 becomes larger as shown in FIG. 14A and also becomes longer as the engine rotation speed N becomes higher. This injection period θT is stored in advance in the ROM 82 in the form of a map shown in FIG. 14B as a function of the depression amount L of the accelerator pedal 12 and the engine rotation speed N. On the other hand, the injection start timing θS becomes earlier as the depression amount L of the accelerator pedal 12 becomes larger as shown in FIG. 15A and becomes earlier as the engine rotation speed N becomes higher. This injection start timing θS is stored in advance in the ROM 82 in the form of the map shown in FIG. 15B as a function of the depression amount L of the accelerator pedal 12 and the engine rotation speed N. Further, as shown in FIG. 16, the target value $\theta C_0$ of the plunger movement start timing becomes slightly slower as the injection start timing θS is made earlier.

Figure 17:
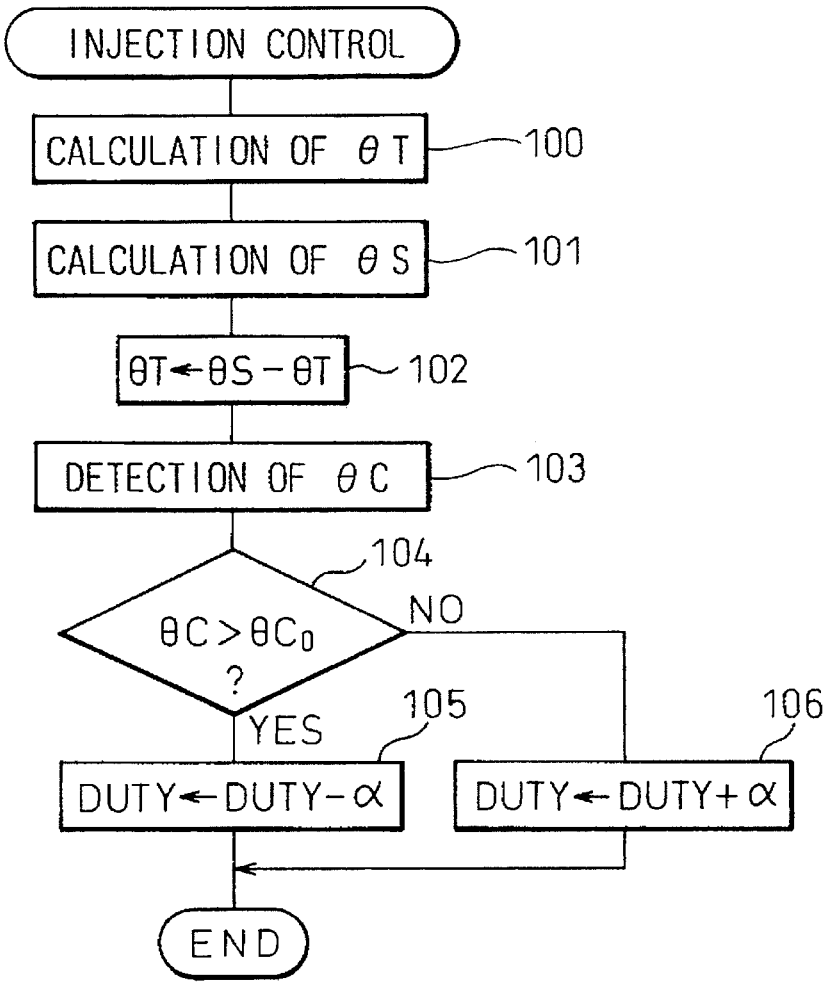
FIG. 17 is a flow chart for performing the control for injection.

FIG. 17 shows a control routine for injection. This routine is executed by for example interruption at every predetermined crank angle.

Figure 14B:
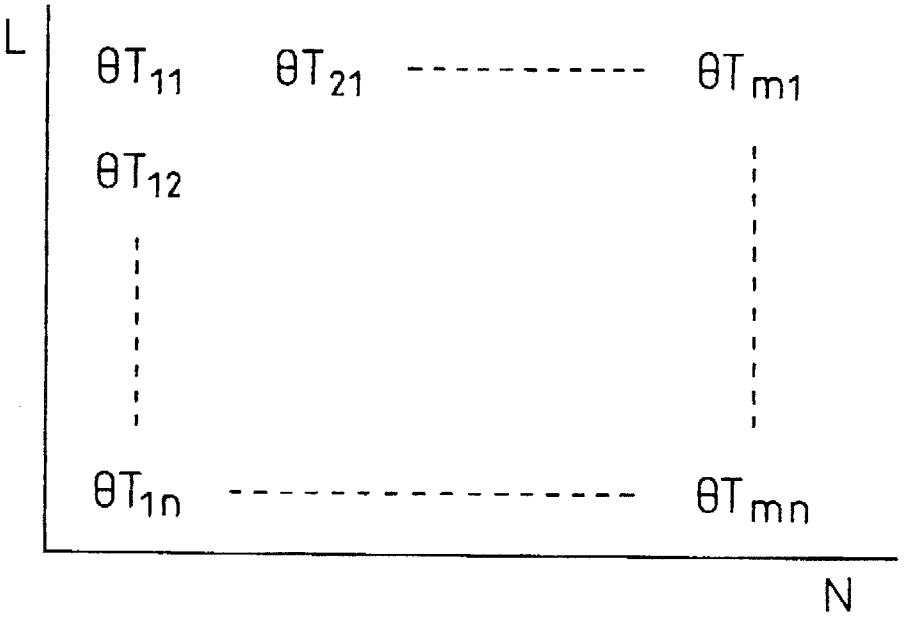

Referring to FIG. 17, first, at step 100, an injection time θT is calculated from the map shown in FIG. 14B. Subsequently, at step 101, the injection start timing θS is calculated from the map shown in FIG. 15B. Subsequently, at step 102, the injection completion timing θE is calculated by subtracting θT from θS. Subsequently, at step 103, a current plunger movement start timing θC is calculated by a piston position detection sensor 55 of the timer device 48. Subsequently, at step 104, the current plunger movement start timing θC is calculated. Subsequently, at step 104, it is judged whether or not the current plunger movement start timing θC is larger than the target value $\theta C_0$ of the plunger movement start timing shown in FIG. 16. When $\theta C > \theta C_0$, the processing routine proceeds to step 105, at which the duty ratio DUTY of the communication control valve 54 is reduced exactly by a constant value α, and when $QC \leqq QC0$, the processing routine proceeds to step 106, at which the constant value α is added to the duty ratio DUTY. By this, the plunger movement start timing θC is controlled to the target value $\theta C_0$.

Figure 18:
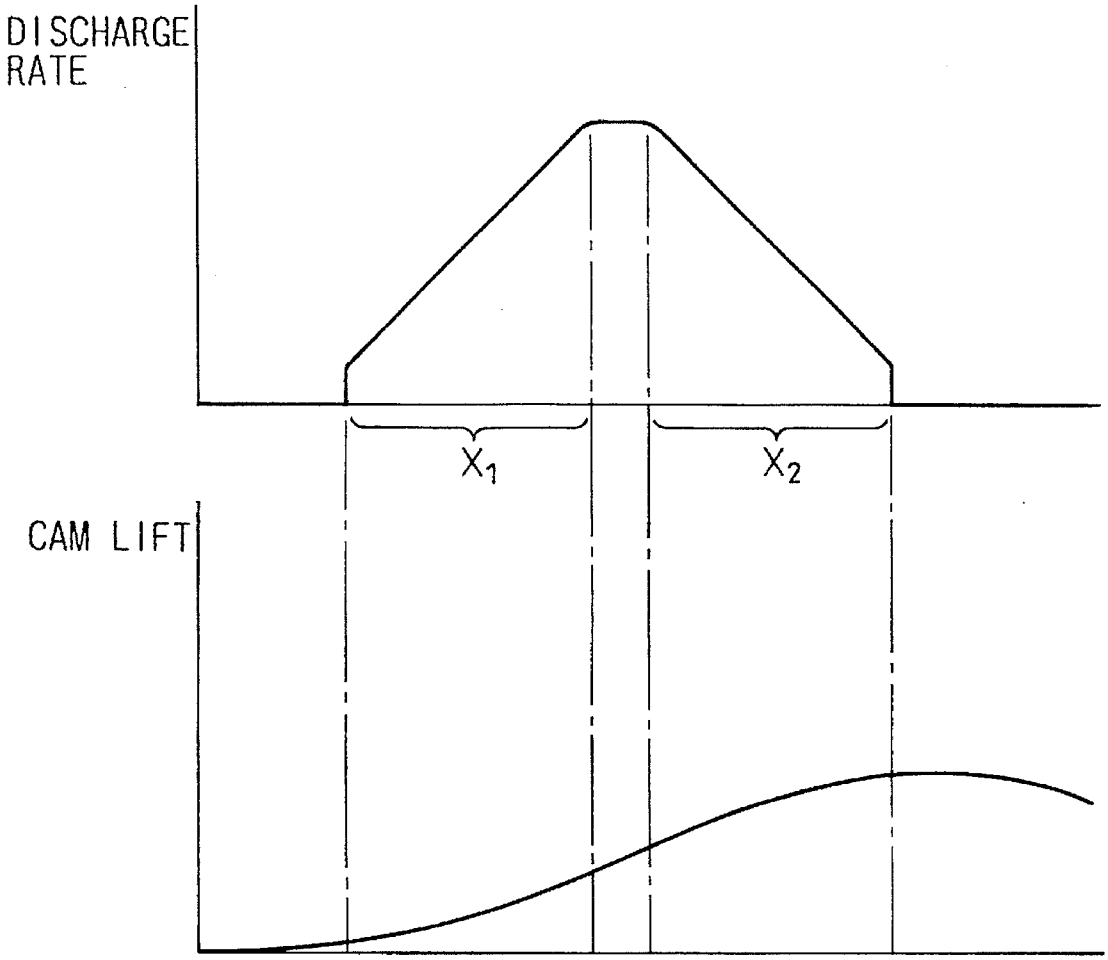
FIG. 18 is a view of relationships between the cam lift and the discharge rate of fuel in another embodiment.
Figure 19:
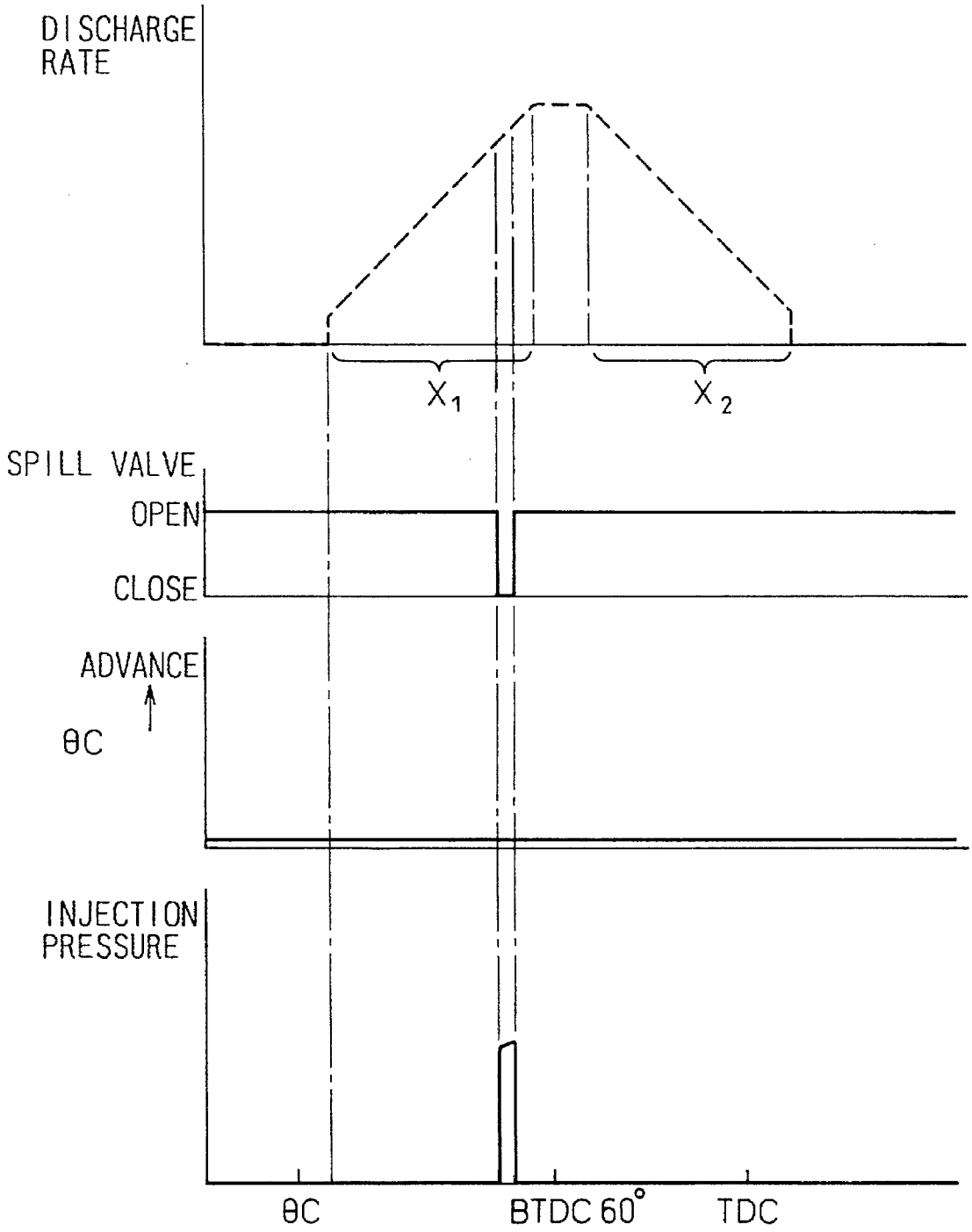
FIG. 19 is a view for explaining the control for injection at the time of the low engine load operation.
Figure 20:
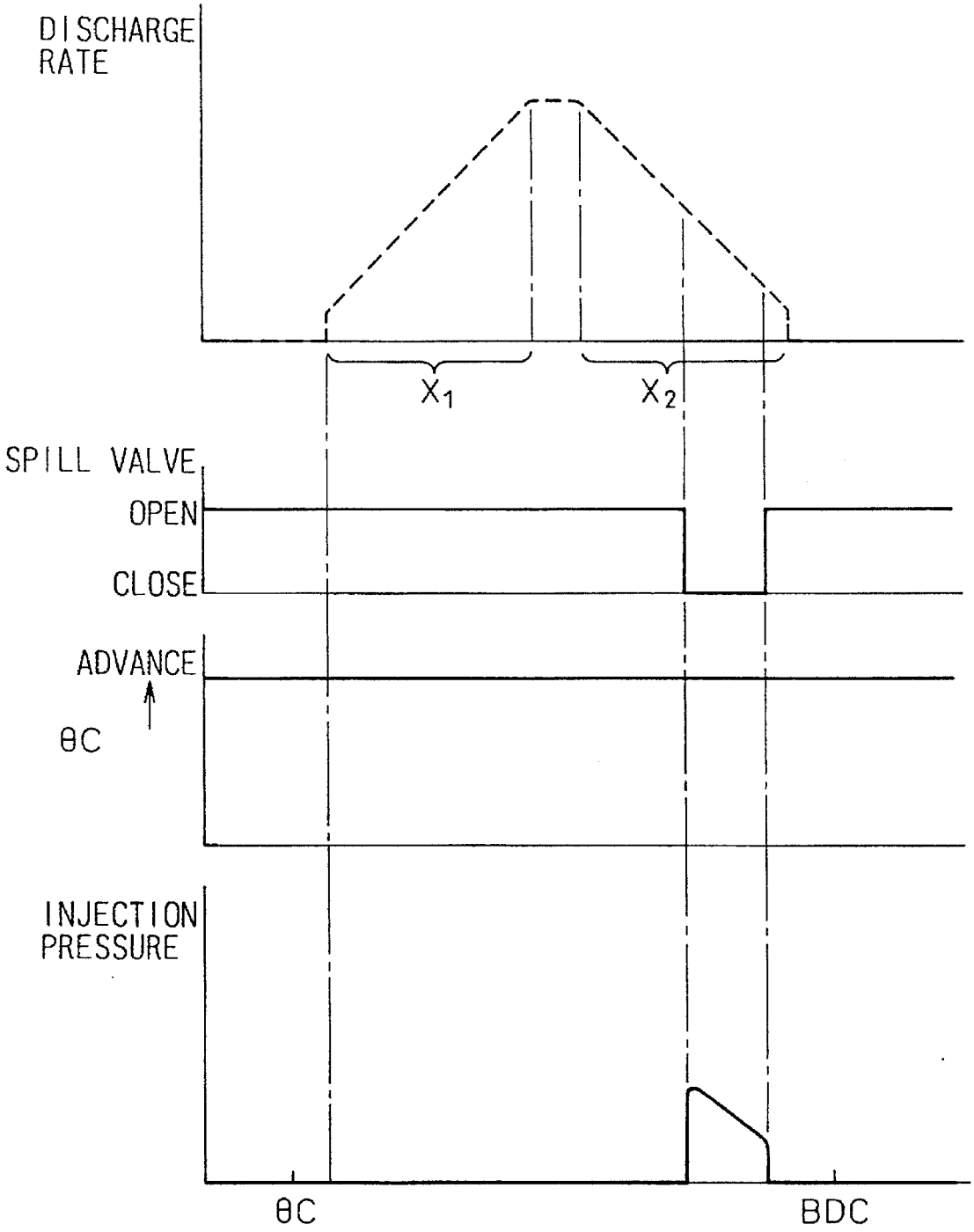
FIG. 20 is a view for explaining the control for injection at the time of a high engine load operation.

FIG. 18 to FIG. 20 show a second embodiment of the method for control of the spread angle of the injected fuel. In this second embodiment, the fuel injection is carried out during the intake stroke before the bottom dead center BTC at the time of a high engine load operation. In this second embodiment, as shown in FIG. 18, the shape of the cam profiles 30 of the cam plate 31 is determined so that the discharge rate of the injection pump 11 is increased in a first half $X_1$ of the discharge action at a substantially constant proportion and decreased at substantially the same constant proportion as that of the first half $X_1$ in the latter half $X_2$ of the discharge action.

In this second embodiment, as shown in FIG. 19, at the time of a low engine load operation, in the first half $X_1$ of the discharge action, the spill valve 40 is closed when the discharge rate is high, and the fuel injection is carried out slightly before BTDC 60°. Accordingly, at this time, as shown in FIG. 9A, the spread angle of the injected fuel becomes large. As opposed to this, at the time of a high engine load operation, as shown in FIG. 20, the spill valve 40 is opened when the discharge rate is low in the latter half $X_2$ of the discharge action, and the fuel injection is carried out during the intake stroke before the bottom dead center BDC. Accordingly, at this time, as shown in FIG. 9B, the spread angle of the injected fuel becomes small.

Further, in this second embodiment, when the fuel injection is carried out at the time of the intake stroke before the bottom dead center BTC, the fuel injection is carried out in the latter half $X_2$ of the discharge action, so the fuel injection pressure is lowered as the piston 4 approaches the bottom dead center BDC, and thus the spread angle of the fuel injection gradually becomes smaller as the piston 4 approaches the bottom dead center BDC. Note that, as shown in FIG. 20, in this second embodiment, at the time of a high engine load operation, the plunger movement start timing θC is considerably advanced in angle.

Figure 21A:
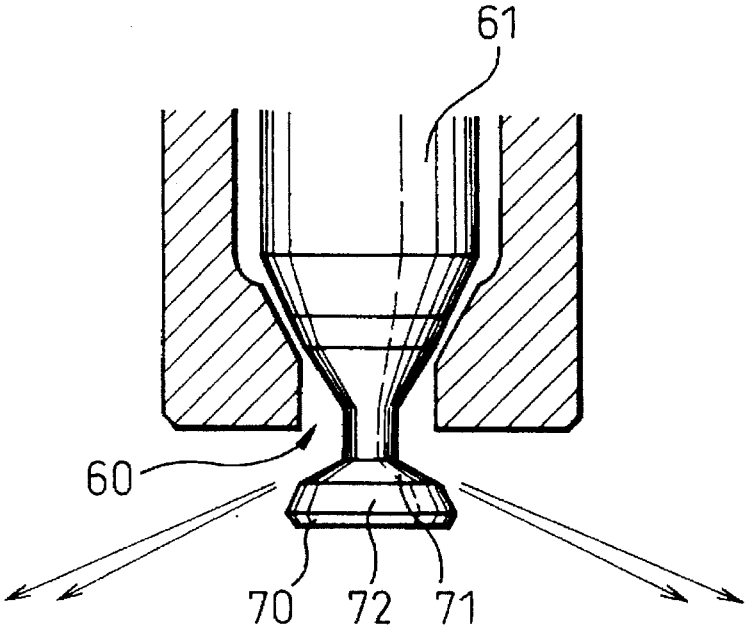
FIGS. 21A and 21B are enlarged side sectional views of a front end of the fuel injector showing another embodiment.
Figure 21B:
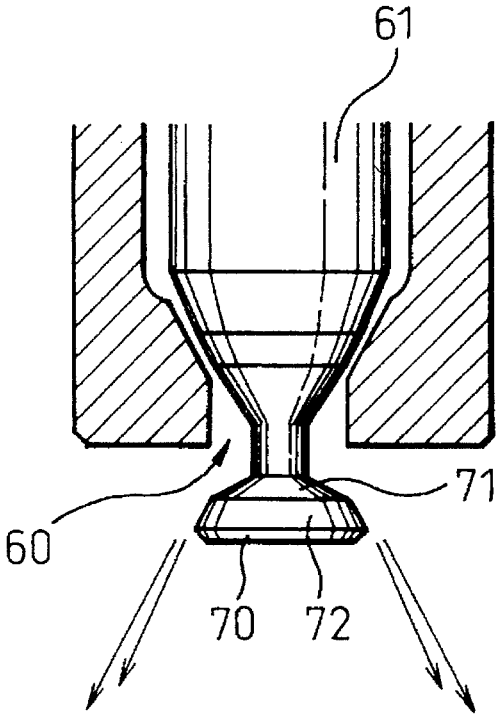

FIGS. 21A and 21B show another embodiment of the fuel injection portion of the fuel injector 10 shown in FIG. 4. In this embodiment, a large diameter portion 68 shown in FIG. 4 is not provided, and a valve body 70 projecting outward from the nozzle 60 is integrally formed on the front end of the needle 61. In this valve body 70 are formed a conical upper wall surface having a big cone angle, that is, a first cone surface 71 in the upper portion thereof, and a conical circumferential wall surface having a small cone angle, that is, a second cone surface 72 in the lower portion thereof. When the fuel injection pressure is high, the flow rate of the injected fuel is fast, so the injected fuel goes along the first cone surface 71 as shown in FIG. 21A, and then scattered to the periphery with the cone angle of the first cone surface 71 as indicated by arrows. Accordingly, at this time, the spread angle of the injected fuel becomes large.

As opposed to this, when the fuel injection pressure is low, the flow rate of the injected fuel is slow, so as shown in FIG. 21B, the injected fuel flows on the first cone surface 71 and then flows on the second cone surface 72 and subsequently scatters from the second cone surface 72. Accordingly, at this time, the injected fuel is scattered to the surroundings with the cone angle of the second cone surface 72, and thus the spread angle of the injected fuel becomes small. Accordingly, even if the fuel injector shown in FIGS. 21A and 21B is used, the spread angle of the injected fuel can be changed by changing the fuel injection pressure.

FIG. 22 to FIG. 29 show still another embodiment of the method for control of the spread angle of the injected fuel. Note that, in this embodiment, similar constituent elements as those shown in FIG. 1 to FIG. 4 are indicated by same references.

Figure 22:
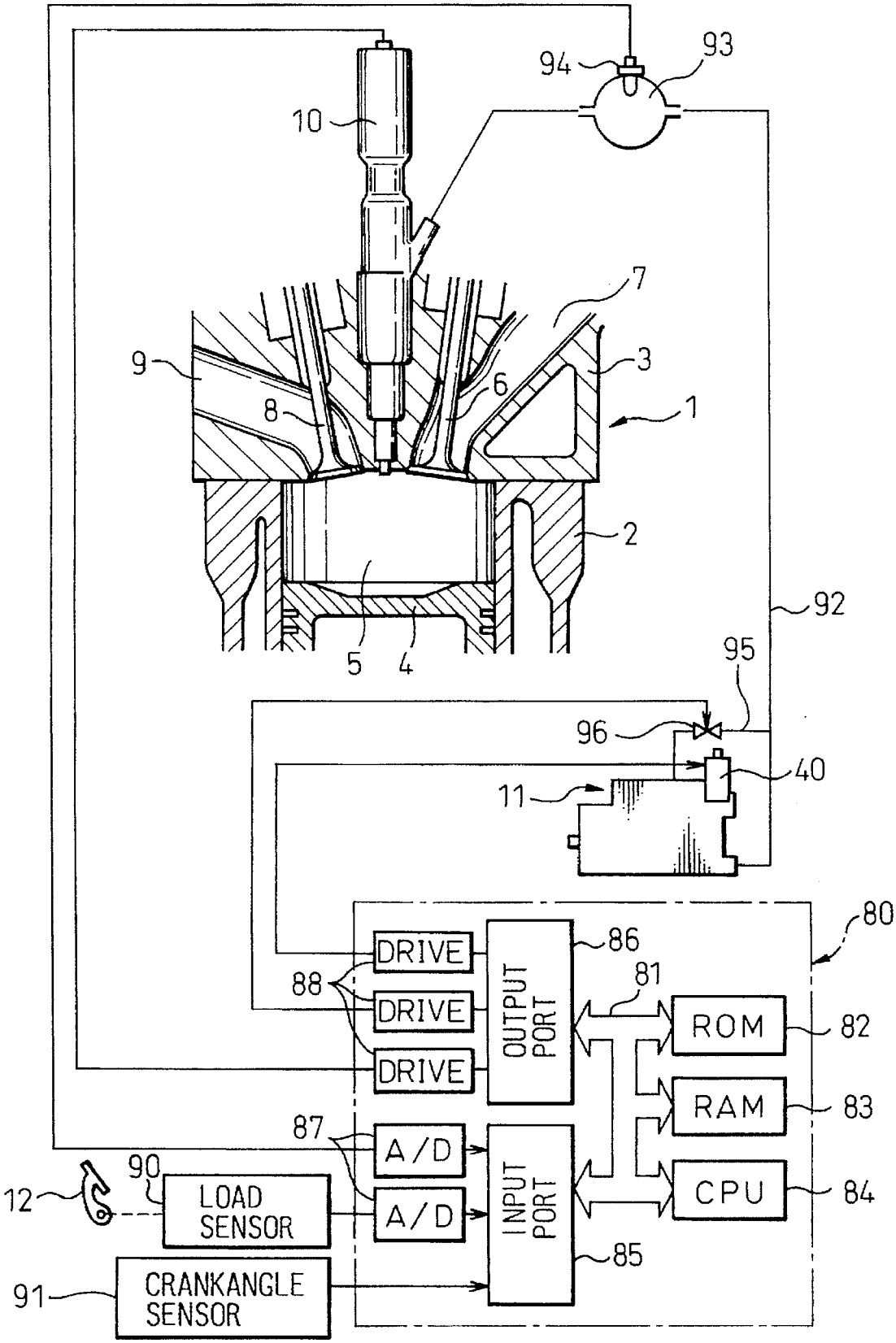
FIG. 22 is a side sectional view showing another embodiment of the compression-ignition type engine.

Referring to FIG. 22, in this embodiment, the fuel discharged from the injection pump 11 is once stored in the reservoir 93 via the fuel conduit 92. The fuel stored in the reservoir 93 is fed into the fuel injector 10. A fuel pressure sensor 94 generating an output voltage proportional to the fuel pressure in the reservoir 93 is arranged in the reservoir 93, and the output voltage of this fuel pressure sensor 94 is input to the input port 85 via the corresponding AD converter 87.

Figure 23:
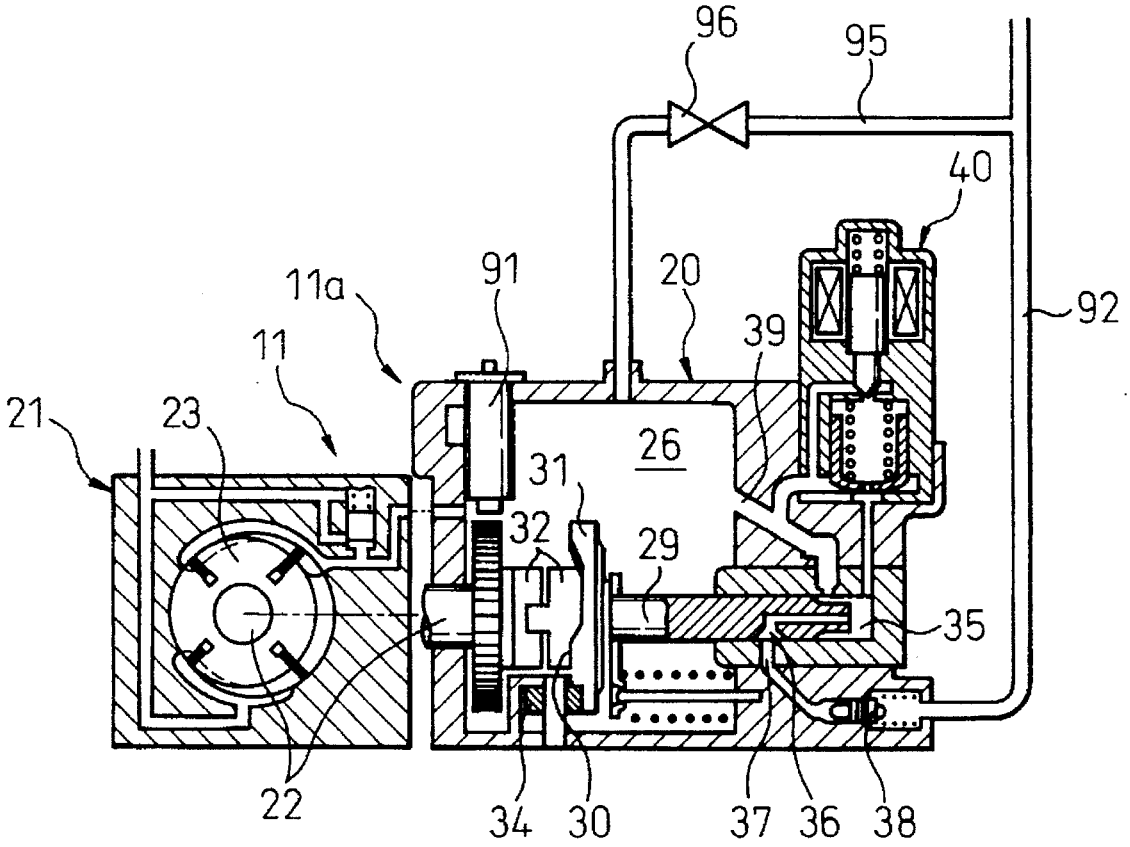
FIG. 23 is a side sectional view showing another embodiment of an injection pump.

On the other hand, as shown in FIG. 23, in this embodiment, the injection pump 11 is not provided with the timer device, and therefore the position of the roller 34 is always held constant. Further, in this embodiment, a by-pass pipe 95 is branched from a fuel conduit 92 extending from the discharge port of the injection pump 11 toward the reservoir 93. This by-pass pipe 95 is connected to the interior of the fuel pressurizing chamber 26. In the by-pass pipe 95 is arranged a relief valve 96 for controlling the fuel discharge. This relief valve 96 is connected to the output port 86 via the corresponding drive circuit 88 as shown in FIG. 22.

Figure 24:
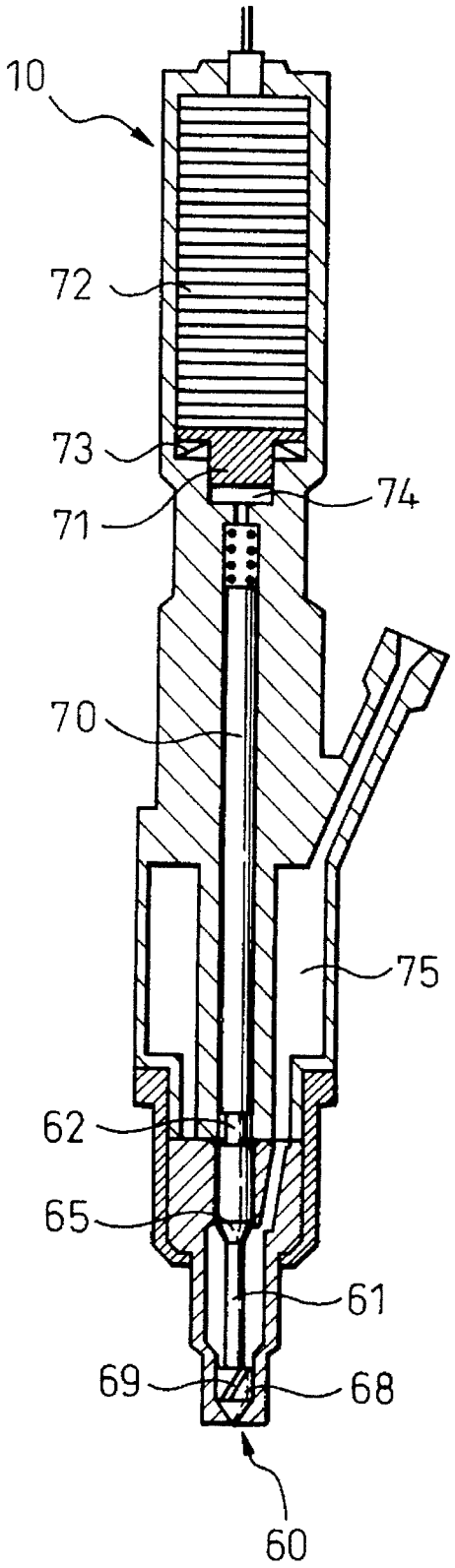
FIG. 24 is a side sectional view showing another embodiment of the fuel injector.

Further, as shown in FIG. 24, also in this embodiment, a large diameter portion 68 having a cylindrical shape is integrally formed in the needle 61 of the fuel injector 10 and an obliquely extending fuel communication groove 69 is formed on the outer circumferential surface of this large diameter portion 68. Accordingly, even by this fuel injector 10, the higher the fuel injection pressure, the smaller the spread angle of the injected fuel. On the other hand, in this embodiment, provision is made of rods 70 arranged in line in the needle 61, a piston 71, a piezoelectric element 72 for driving the piston 71, and a coned disc spring 73 for pressing the piston 71 toward the piezoelectric element 72. An pressure control chamber 74 filled with fuel is formed between the rod 70 and the piston 71. Further, around the rod 70, a fuel storage chamber 75 is formed. This fuel storage chamber 75 is connected to the nozzle port on the one hand and connected to the interior of the reservoir 93 on the other hand.

The piezoelectric element 72 is connected to the output port 86 via the corresponding drive circuit 88 as shown in FIG. 22. When the piezoelectric element 72 is charged, the piezoelectric element 72 extends in the axial direction, and thus the piston 71 moves downward. As a result, the fuel pressure in the pressure control chamber 74 rises, so the needle 61 is biased downward via the rod 70, and thus the fuel injection is stopped. On the other hand, when the piezoelectric element 72 is discharged, the piezoelectric element 71 retracts in the axial direction, and thus the piston 71 rises. As a result, the fuel pressure in the pressure control chamber 74 is lowered, so the needle 61 rises by the fuel pressure acting upon the pressure receiving surface of the needle 61, and thus the fuel injection is started.

In this embodiment, by performing the drive control of the piezoelectric element 72, the fuel injection timing is controlled. Further, in this embodiment, the fuel pressure in the reservoir 93 is controlled so that the fuel injection pressure becomes lower as the fuel injection timing becomes closer to the bottom dead center BDC.

Figure 25A:
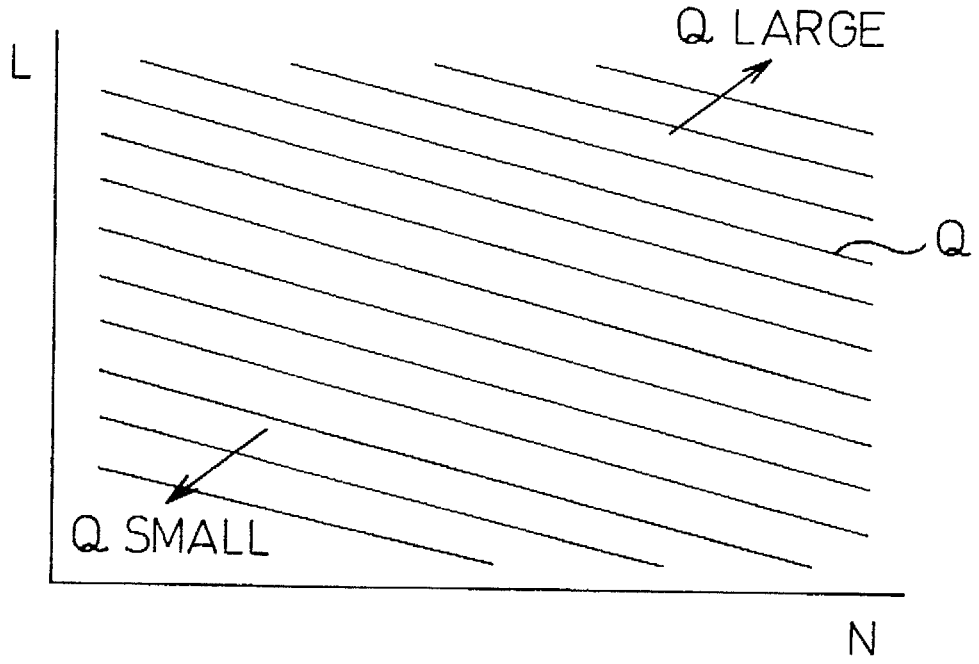
FIGS. 25A and 25B are views of an injection amount Q.
Figure 26A:
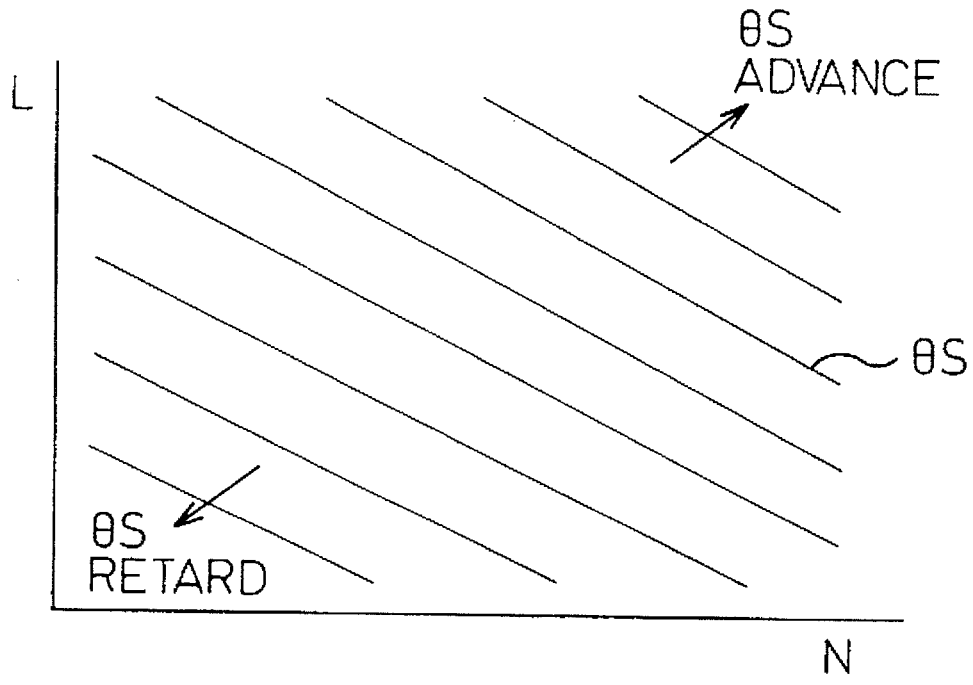
FIGS. 26A and 26B are views of an injection start timing θS.
Figure 26B:
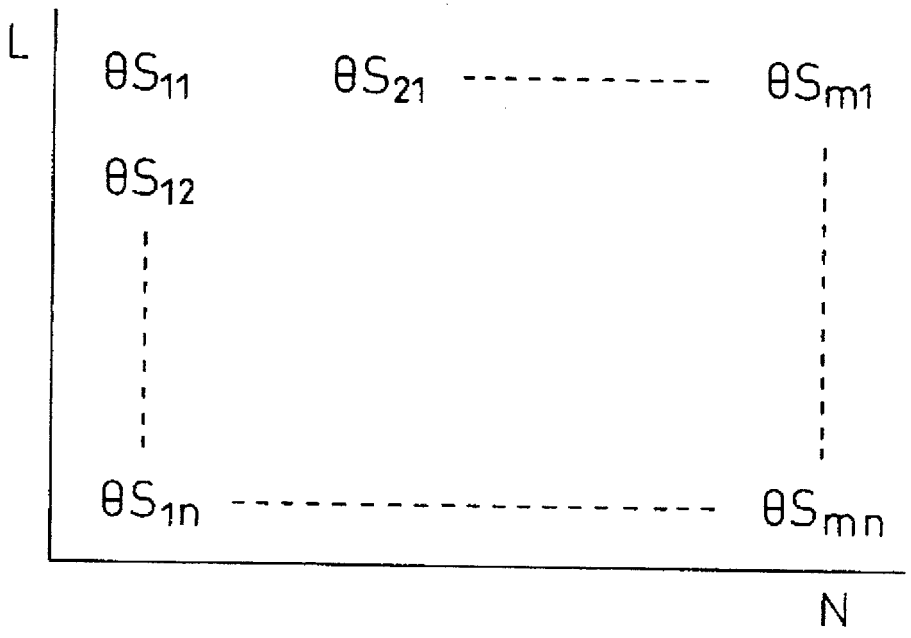
Figure 27:
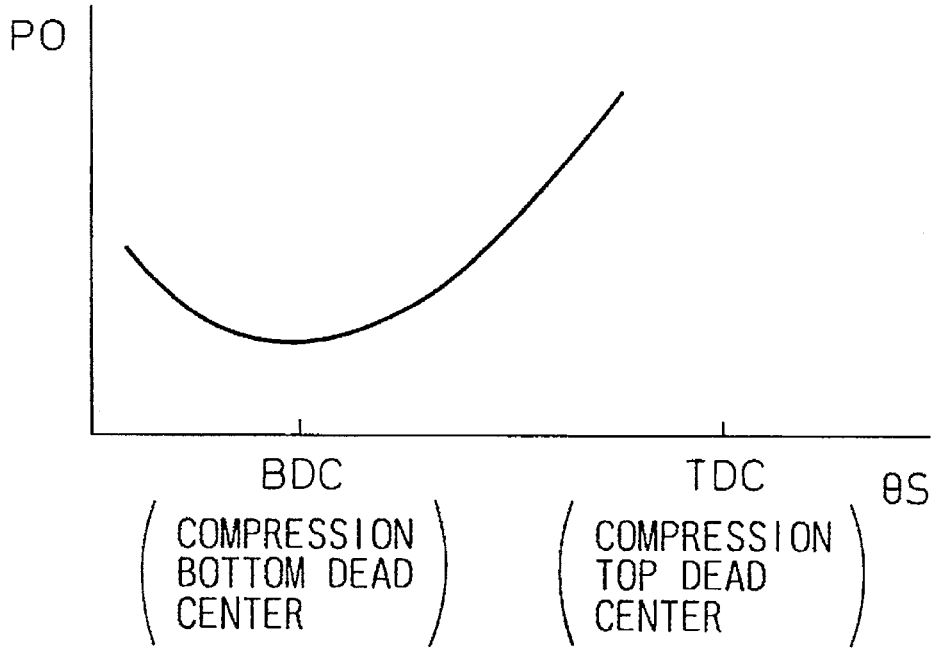
FIG. 27 is a view of relationships between a target fuel pressure PO in a reservoir and the injection start timing θS.

As shown in FIG. 25A, the injection amount Q becomes larger as the depression amount L of the accelerator pedal 12 becomes larger and becomes larger as the engine rotation speed N becomes higher. This injection amount Q is stored in advance in the ROM 82 in the form of the map shown in FIG. 25B as a function of the depression amount L of the accelerator pedal 12 and the engine rotation speed N. On the other hand, as shown in FIG. 26A, the injection start timing θS becomes earlier as the depression amount L of the accelerator pedal 12 becomes larger and becomes earlier as the engine operation speed N becomes higher. This injection start timing θS is stored in advance in the ROM 82 in the form of the map shown in FIG. 26B as a function of the depression amount L of the accelerator pedal 12 and the engine rotation speed N. Further, as shown in FIG. 27, the target fuel pressure PO in the reservoir 93 becomes lower as the injection start timing θS becomes closer to the bottom dead center BDC.

Figure 28:
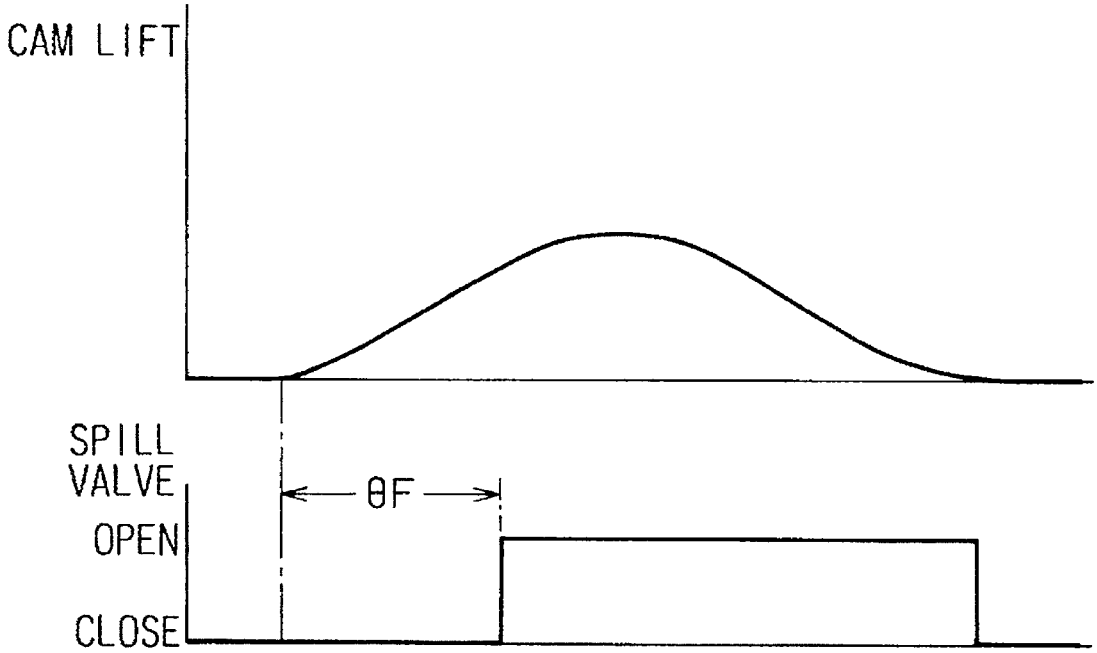
FIG. 28 is a view of an opening and closing control of a spill valve.

Further, in this embodiment, as shown in FIG. 28, when the cam lift of the cam profiles 30 of the cam plate 31 (FIG. 23) starts to rise, the spill valve 40 is closed, and after a while, the spill valve 40 is opened. When the spill valve 40 becomes open, the supply of fuel into the reservoir 93 is stopped. In this embodiment, the fuel pressure in the reservoir 93 is controlled by controlling a period θf from the start of rise of the cam lift until the spill valve 40 becomes open.

Figure 29:
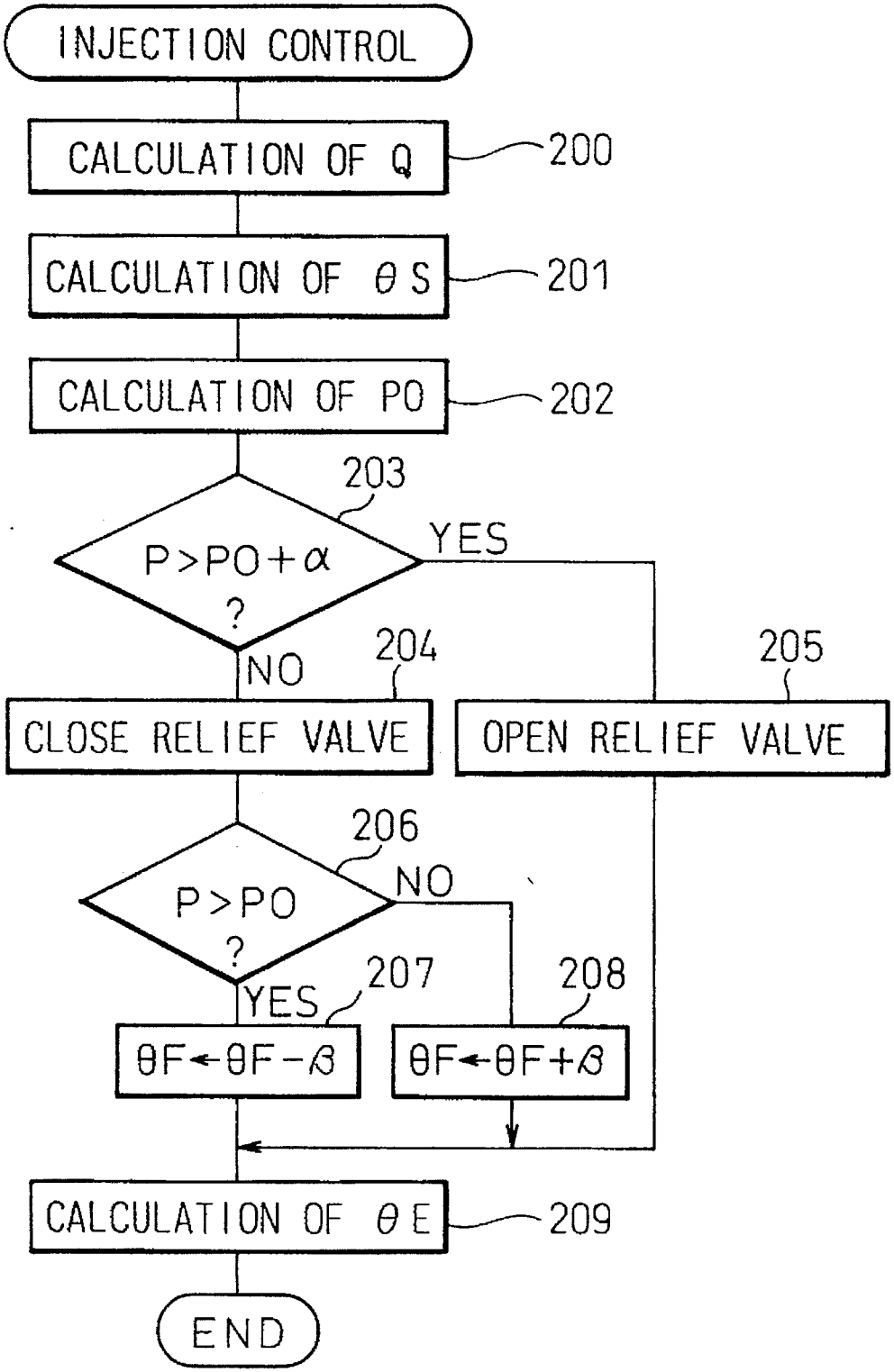
FIG. 29 is a flow chart for performing the control of the fuel injection.

FIG. 29 shows an injection control routine. This routine is executed by for example interruption at every predetermined crank angle.

Figure 25B:
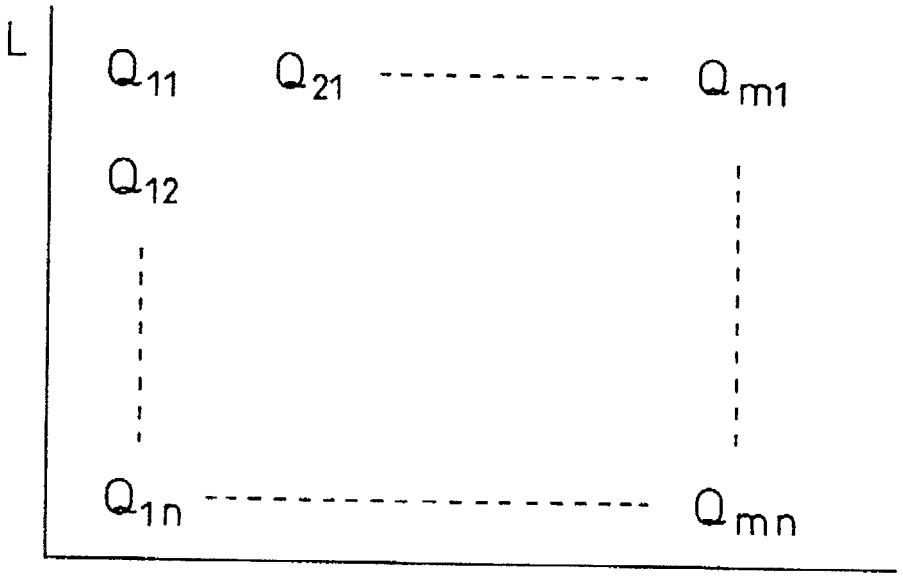

Referring to FIG. 29, first of all, at step 200, the injection amount Q is calculated from the map shown in FIG. 25B. Subsequently, at step 201, the injection start timing θS is calculated from the map shown in FIG. 26B. Subsequently, at step 202, the target fuel pressure PO is calculated from the injection start timing θS based on the relationships shown in FIG. 27. Subsequently, at step 203, it is judged whether or not the fuel pressure P detected by the fuel pressure sensor 94 is higher than the target fuel pressure PO plus the constant pressure α, that is, whether or not the fuel pressure P in the reservoir tank 93 is considerably higher than the target fuel pressure PO. When $P>PO+\alpha$, the processing routine proceeds to step 205, at which the relief valve 96 is opened, and then the processing routine proceeds to step 209. When the relief valve 96 is opened, the fuel pressure in the reservoir 93 is rapidly lowered. As opposed to this, when $P\leqq PO+\alpha$, the processing routine proceeds to step 204, at which the relief valve 96 is closed, and then the processing routine proceeds to step 206.

At step 206, it is judged whether or not the fuel pressure P in the reservoir 93 is higher than the target fuel pressure PO. When $P>PO$, the processing routine proceeds to step 207, at which the period θF shown in FIG. 28 is decreased exactly by the constant value β. On the other hand, when P≦PO, the processing routine proceeds to step 208, at which the period θF shown in FIG. 28 is increased exactly by the constant value β. In this way, the fuel pressure P in the reservoir 93 is controlled to the target fuel pressure PO. Subsequently, at step 209, the injection completion timing θE is calculated based on the injection amount Q, the injection start timing θS, and the fuel pressure P in the reservoir 93.

Figure 30:
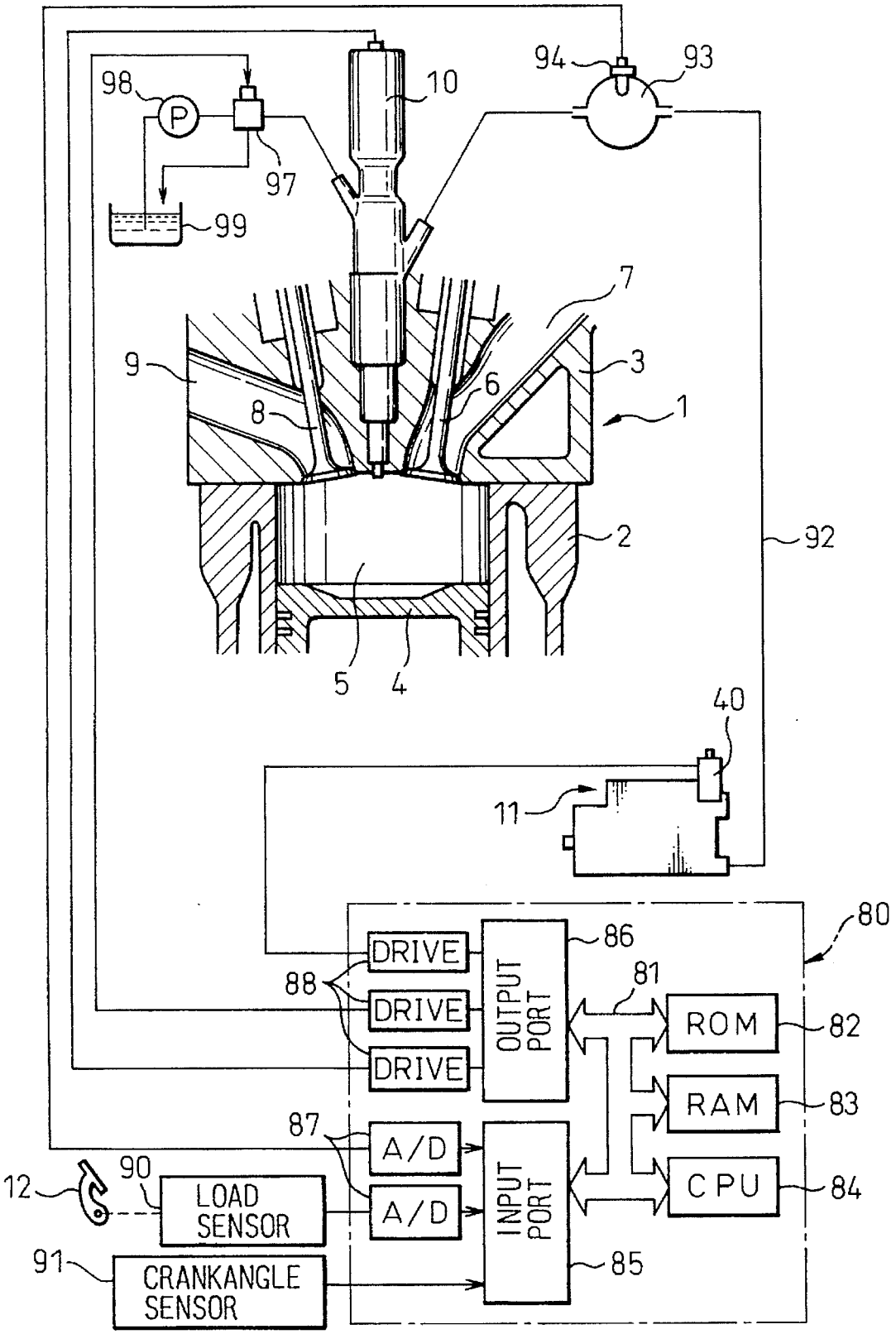
FIG. 30 is a side sectional view of still another embodiment of the compression-ignition type engine.

FIG. 30 to FIG. 36 show still another embodiment of the method for control of the spread angle of the injected fuel. Also in this embodiment, similar constituent elements as those in the embodiment shown in FIG. 1 to FIG. 4 and embodiment shown in FIG. 22 to FIG. 24 are indicated by same references. As shown in FIG. 30, in this embodiment, the injection pump 11 does not have a timer device and does not have a by-pass pipe.

Figure 31:
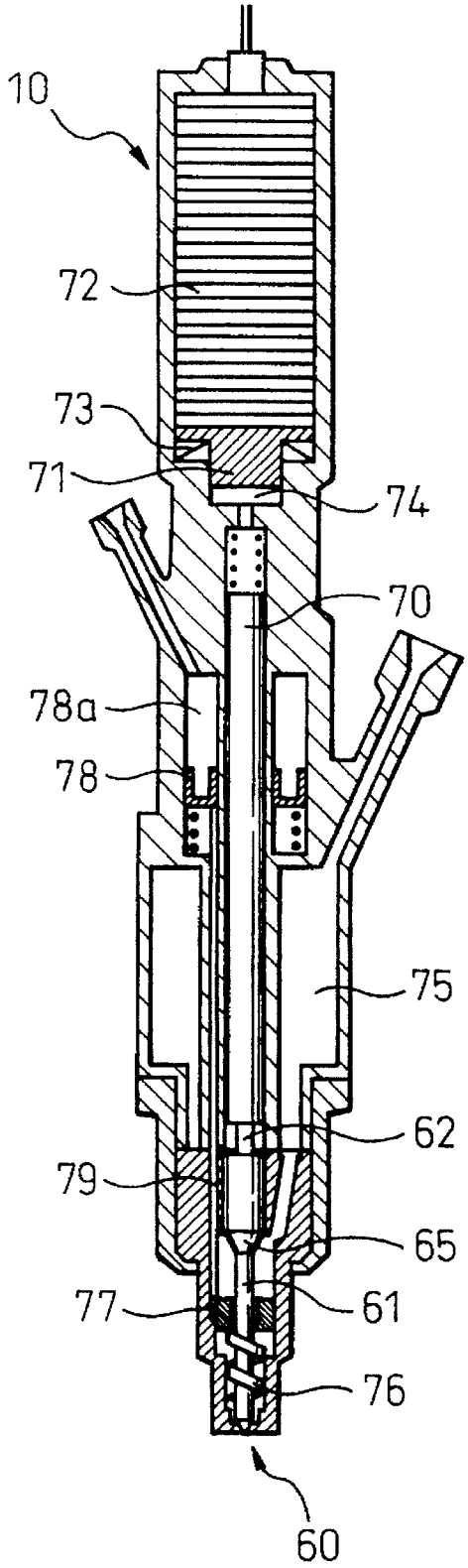
FIG. 31 is a side sectional view of still another embodiment of the fuel injector.

Referring to FIG. 31, also in this embodiment, the needle 61 is controlled by the piezoelectric element 72. On the other hand, in this embodiment, an elastic body 76 exhibiting a spiral shape is arranged around the front end of the needle 61. In this spiral elastic body 76, the inner circumferential surface exhibits a rectangular sectional shape in contact with the top of the outer circumferential surface of the needle 61, and the top end of the spiral elastic body 76 is seated on a slider 77. An annular piston 78 slidable in the axial direction of the rod 70 is inserted above the fuel storage chamber 75, and the slider 77 is connected to the annular piston 78 via a connection rod 79. Accordingly, when the piston 78 vertically moves, the slider 77 vertically moves along with this.

A pressure control chamber **78*a* is formed above the annular piston 78. This pressure control chamber 78*a* is connected to the fuel tank 99 via a relief valve 97 which can control the relief pressure and a fuel supply pump 98 as shown in FIG. 30. The relief valve 97 is connected to the output port 86 via the corresponding drive circuit 88. The fuel in the pressure control chamber 78*a* is controlled to the predetermined fuel pressure by the relief valve 97 based on the output signal of the electronic control unit 80**.

Figure 32A:
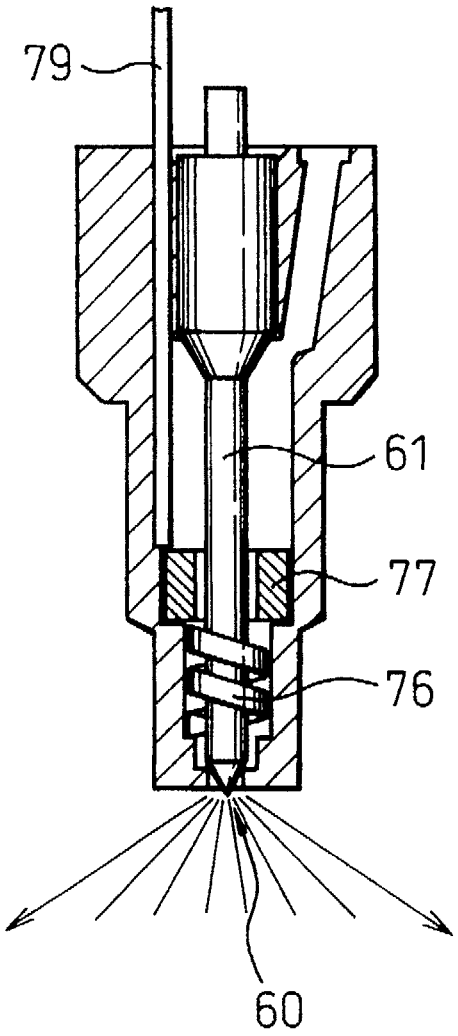
FIGS. 32A and 32B are side sectional views of the front end of the fuel injector shown in FIG. 31.
Figure 32B:
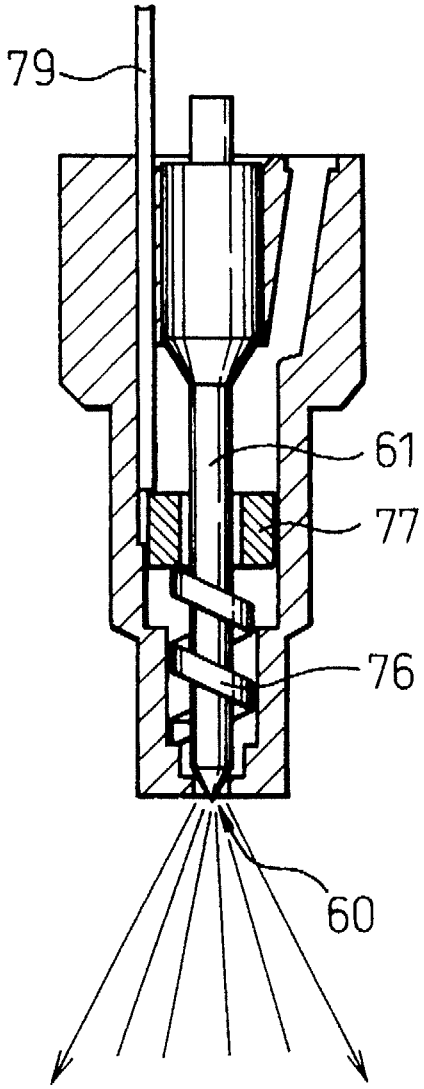

When the fuel pressure in the pressure control chamber 78 is raised by the relief valve 97, the piston 78 moves downward, and the slider 77 also moves downward as shown in FIG. 32A. When the slider 77 moves downward, the spiral elastic body 76 shrinks in the axial line direction of the needle 61, and thus the swirl force given to the flow of fuel flowing in the spiral elastic body 76 is strengthened. As a result, the spread angle of the fuel injected from the nozzle port 60 becomes big. Opposed to this, when the fuel pressure in the pressure control chamber **78*a* is lowered by the relief valve 97, the piston 78 rises, and as shown in FIG. 32B, also the slider 77 rises. When the slider 77 rises, the spiral elastic body 76 extends in the axial line direction of the needle 61, and thus the swirl force given to the flow of fuel flowing in the spiral elastic body 76 is weakened. As a result, the spread angle of the fuel injected from the nozzle port 60** becomes small.

In this way, in this embodiment, by controlling the fuel pressure in the pressure control chamber **78*a*, the spread angle of the injected fuel is controlled. Note that, in this embodiment, by controlling the period θF shown in FIG. 28, the fuel pressure in the reservoir 93** is controlled to a constant pressure.

Figure 33A:
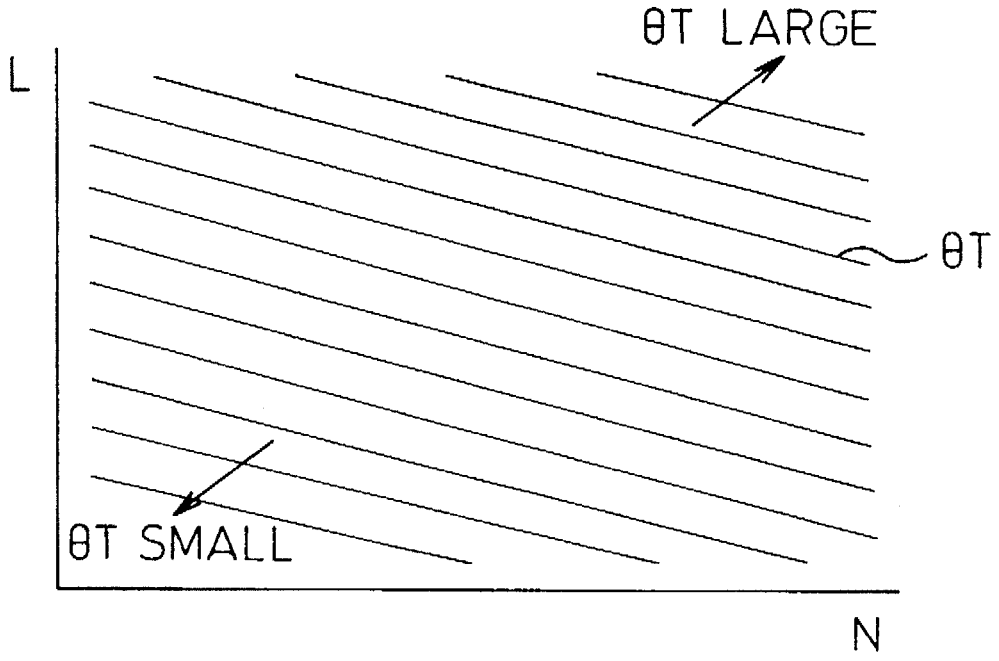
FIGS. 33A and 33B are views of the injection time θT.
Figure 34A:
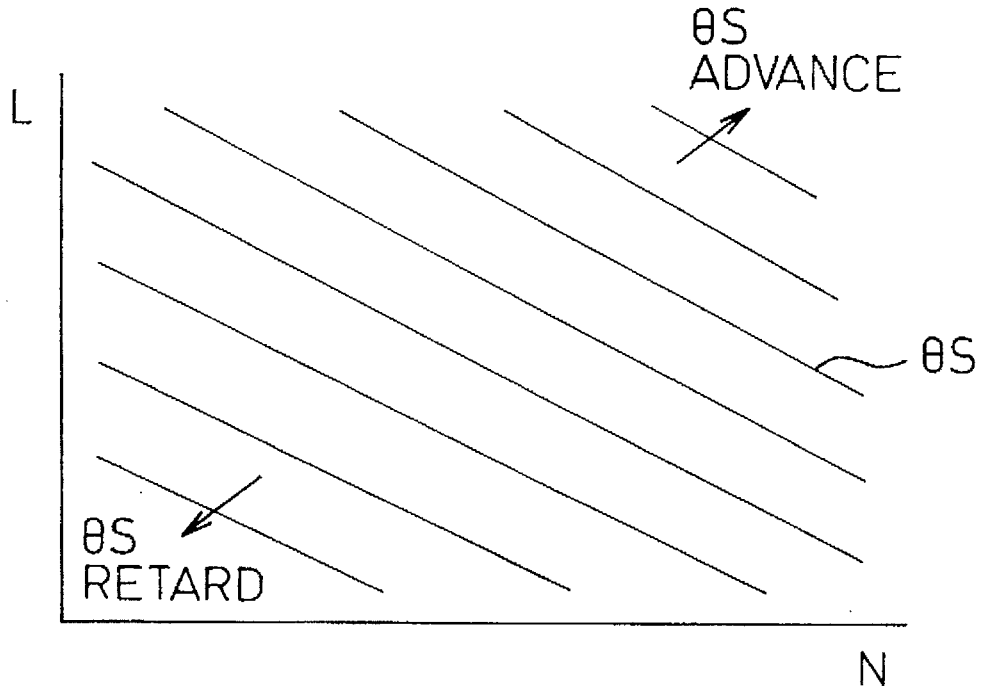
FIGS. 34A and 34B are views of the injection start timing θS.
Figure 34B:
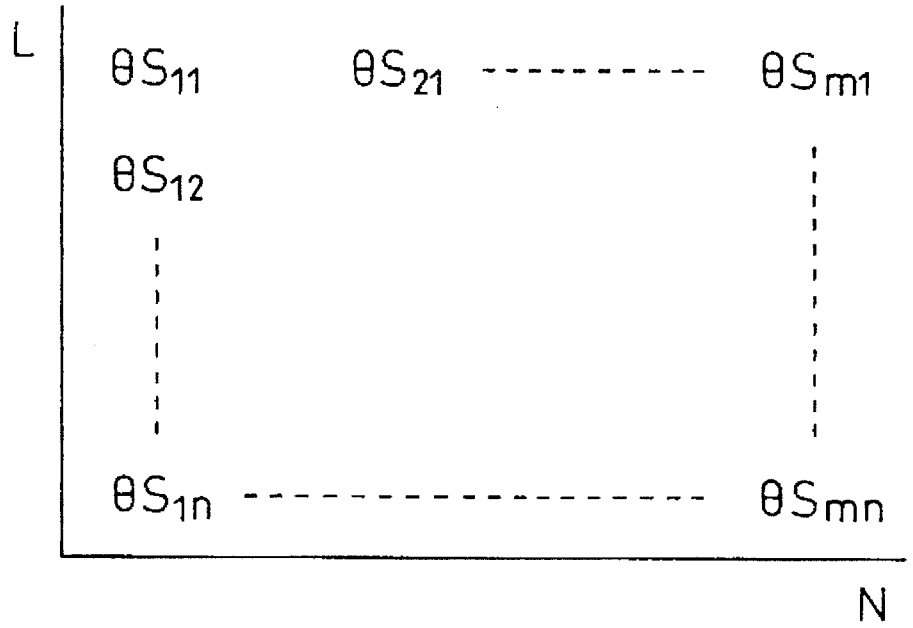
Figure 35:
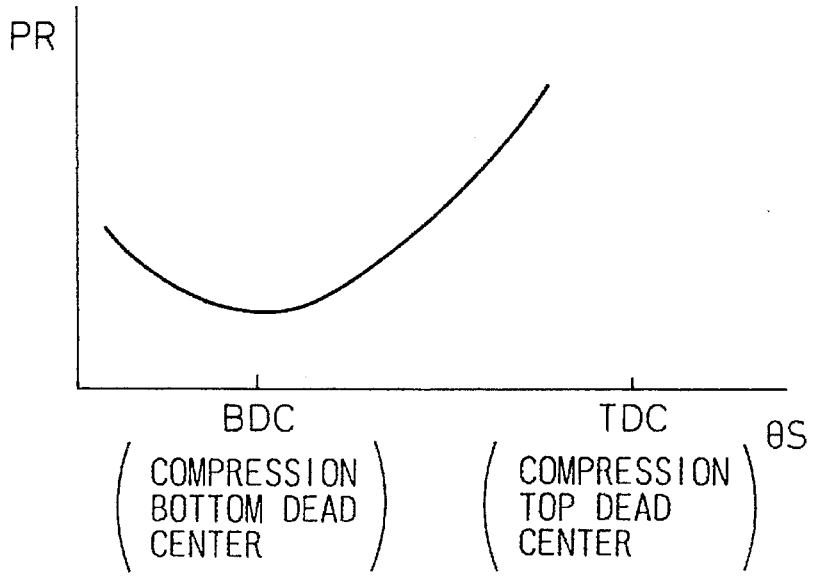
FIG. 35 is a view of relationships between the fuel pressure PR in the pressure control chamber for controlling a spiral elastic body and the injection start timing θS.

As shown in FIG. 33A, the injection period θT becomes longer as the depression amount L of the accelerator pedal 12 becomes larger and becomes longer as the engine rotation speed N becomes higher. This injection period θT is stored in advance in the ROM 82 in the form of the map shown in FIG. 33B as a function of the depression amount L of the accelerator pedal 12 and the engine rotation speed N. On the other hand, as shown in FIG. 34A, the injection start timing θS becomes earlier as the depression amount L of the accelerator pedal 12 becomes larger and becomes earlier as the engine rotation speed N becomes higher. This injection start timing θS is stored in advance in the ROM 82 in the form of the map shown in FIG. 34B as a function of the depression amount L of the accelerator pedal 12 and the engine rotation speed N. Further, as shown in FIG. 35, the fuel pressure PR in the pressure control chamber **78*a*** is made higher as the injection start timing θS becomes closer to the bottom dead center BDC.

Figure 36:
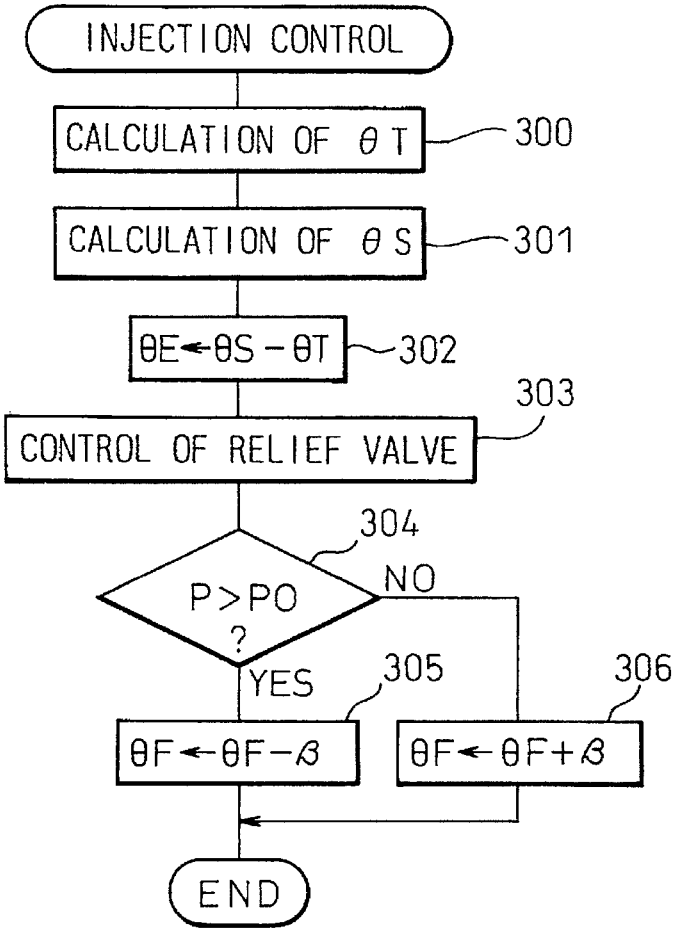
FIG. 36 is a flow chart for performing the control of the fuel injection.

FIG. 36 shows the injection control routine. This routine is executed by for example interruption at every predetermined crank angle.

Figure 33B:
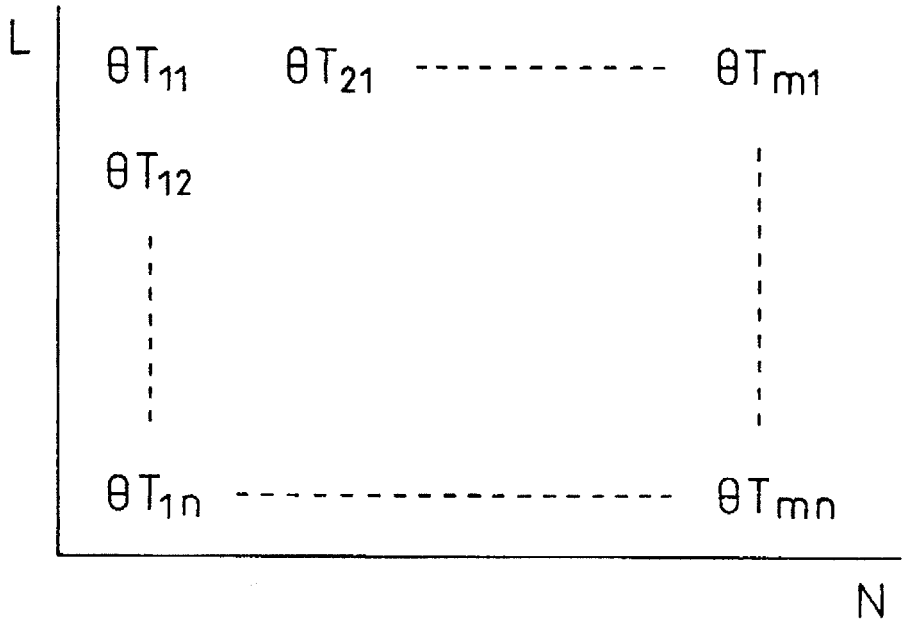

Referring to FIG. 36, first of all, at step 300, the injection time θT is calculated from the map shown in FIG. 33B. Subsequently, at step 301, the injection start timing θS is calculated from the map shown in FIG. 34B. Subsequently, at step 302, the injection completion timing θE is calculated by subtracting θT from θS. Subsequently, at step 303, the relief valve 97 is controlled so that the fuel pressure in the pressure control chamber **78*a* becomes the fuel pressure PR shown in FIG. 35 in accordance with the injection start timing θS. Subsequently, at step 304, it is judged whether or not the fuel pressure P in the reservoir 93 is higher than the constant target fuel pressure PO. When P>PO, the processing routine proceeds to step 305, at which the period θF shown in FIG. 28 is decreased exactly by the constant value β. On the other hand, when P≦PO, the period θF shown in FIG. 28 is increased exactly by the constant value β. In this way, the fuel pressure P in the reservoir 93** is maintained at the constant target fuel pressure PO.

Note that, an explanation was made heretofore of a case where the present invention was applied to a four-stroke engine, but the present invention can be applied to a two-stroke engine too. Also in this case, the fuel injection is carried out at the time of the compression stroke before 60 degrees before about top dead center BTDC of the compression stroke or at the time of the intake stroke where new air is flowing in, that is, at the time of a discharge stroke.

While the invention has been described with reference to specific embodiments chosen for purposes of illustration, it should be apparent that numerous modifications could be made thereto by those skilled in the art without departing from the basic concept and scope of the invention.

I claim:

1. A compression-ignition type engine having a piston and a combustion chamber defined by the piston, said engine comprising:

injection means for conically injecting fuel into the combustion chamber toward a top face of the piston and forming fuel droplets dispersed in the combustion chamber, the mean value of the particle size of said fuel droplets being larger than a predetermined particle size at which the temperature of the fuel droplets having the predetermined particle size reaches a boiling point of a main component of said fuel, which boiling point is determined by pressure in the combustion chamber, at about the top dead center of the compression stroke;

injection time control means for controlling said injection means to carry out an injecting action at a predetermined timing during a period from the start of an intake stroke to approximately 60 degrees before top dead center of the compression stroke; and spread angle control means for controlling a spread angle of the conically injected fuel to make said spread angle smaller as the position of the piston becomes closer to the bottom dead center when the fuel injection is carried out.

2. A compression-ignition type engine as set forth in claim 1, wherein the mean particle size of the fuel droplets is more than about 500 μm.

3. A compression-ignition type engine as set forth in claim 1, wherein said injection timing control means makes the injection timing earlier as the engine load is higher in accordance with the load of the engine.

4. A compression-ignition type engine as set forth in claim 1, wherein said fuel injection means is provided with a fuel injector arranged in a combustion chamber; said fuel injector is provided with a fuel injection portion having a structure wherein the higher the fuel injection pressure, the larger the said spread angle; and said spread angle control means controls said spread angle by controlling the fuel injection pressure.

5. A compression-ignition type engine as set forth in claim 4, wherein the fuel injection portion of said fuel injector is provided with a nozzle port and a needle controlling the opening and closing of the nozzle port; a cylindrical large diameter portion is formed in an end of the nozzle port side of the needle; and an obliquely extending fuel communication groove is formed in an outer circumferential surface of said cylindrical large diameter portion.

6. A compression-ignition type engine as set forth in claim 4, wherein the fuel injection portion of said fuel injector is provided with a needle projecting out into the combustion chamber and a valve body integrally formed on a projecting front end of the needle; and said valve body is provided with a conical upper wall surface having a large cone angle and a conical circumferential wall surface having a small cone angle.

7. A compression-ignition type engine as set forth in claim 4, wherein said injection means is provided with a fuel pump for supplying the fuel to the fuel injector; said fuel pump is comprised of a pump with a discharge rate of fuel which changes along with the elapse of time; and said spread angle control means controls the fuel injection pressure by changing the timing of discharge of the fuel from the fuel pump.

8. A compression-ignition type engine as set forth in claim 4, wherein said injection means is provided with a fuel pump and a fuel reservoir arranged between the fuel pump and the fuel injector; and said spread angle control means controls the fuel injection pressure by changing the fuel pressure in the fuel reservoir.

9. A compression-ignition type engine as set forth in claim 4, wherein the fuel injector has a fuel storage chamber inside of it.

10. A compression-ignition type engine as set forth in claim 1, wherein said injection means is provided with a fuel injector arranged in the combustion chamber; and said spread angle control means is provided with a variable spread angle device arranged in the fuel injector.

11. A compression-ignition type engine as set forth in claim 10, wherein the fuel injector is provided with a nozzle port and a needle controlling the opening and closing of the nozzle port; and said variable spread angle device is provided with a spiral elastic body inserted around the end of the needle of the nozzle port side and a drive device for making said spiral elastic body extend or retract in an axial direction of the needle.

12. A compression-ignition type engine as set forth in claim 1, wherein the spread angle of fuel is continuously changed along with the change of position of the piston.

* * * * *